US006899214B2

(12) United States Patent
Morikawa

(10) Patent No.: US 6,899,214 B2
(45) Date of Patent: May 31, 2005

(54) COIN RECEIVING AND DISPENSING MACHINE

(75) Inventor: Jun Morikawa, Chiba (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 180 days.

(21) Appl. No.: 10/445,507

(22) Filed: May 27, 2003

(65) Prior Publication Data

US 2003/0221933 A1 Dec. 4, 2003

(30) Foreign Application Priority Data

May 29, 2002 (JP) ..... 2002-155949

(51) Int. Cl.[7] ..... G07F 5/00
(52) U.S. Cl. ..... 194/302
(58) Field of Search ..... 194/302, 215, 194/216, 217

(56) References Cited

U.S. PATENT DOCUMENTS 4,558,711 A * 12/1985 Ikuta et al. ..... 453/3
4,558,712 A 12/1985 Sentoku et al.
4,635,661 A * 1/1987 Uematsu et al. ..... 194/217
5,021,026 A 6/1991 Goi
5,366,407 A 11/1994 Sentoku

FOREIGN PATENT DOCUMENTS

EP 0 137 637 4/1985
EP 0 563 395 A1 10/1993
EP 1 049 052 A2 11/2000
WO WO 99/06969 2/1999

* cited by examiner

*Primary Examiner*—Donald P Walsh
*Assistant Examiner*—Mark J. Beauchaine
(74) *Attorney, Agent, or Firm*—Cohen, Pontani, Lieberman & Pavane

(57) ABSTRACT

A coin receiving and dispensing machine includes a coin receiving and dispensing opening, a sensor unit provided in a coin passage and adapted for discriminating and counting coins of each denomination, a single coin storing box for storing acceptable coins, a coin storing cylinder for storing coins to be dispensed and a controller for controlling overall operation of the coin receiving and dispensing machine, and the controller is constituted so as to, prior to dispensation of coins, take out coins stored in the coin storing box, cause the sensor unit to discriminate and counts coins for each denomination taken out from the coin storing box, and store a predetermined number of coins in the coin storing cylinder for each denomination, the controller being further constituted so as to, when coins are to be dispensed, take out coins stored in the coin storing cylinder, cause the sensor unit to discriminate and count coins taken out from the coin storing cylinder for each denomination, and feed the coins to the coin receiving and dispensing opening based on the discrimination and counting done by the sensor unit, the controller furthermore being constituted so as to cause the sensor unit to discriminate whether or not coins deposited through the coin receiving and dispensing opening are acceptable and denominations of coins and count the number of the coins of each denomination, and store the coins deposited through the coin receiving and dispensing opening in the coin storing box.

27 Claims, 14 Drawing Sheets

COIN RECEIVING AND DISPENSING MACHINE

BACKGROUND OF THE INVENTION

The present invention relates to a coin receiving and dispensing machine and, particularly, to such a machine which can be made compact and low in cost and can easily receive and dispense coins of a newly issued denomination.

DESCRIPTION OF THE PRIOR ART

Japanese Patent No. 2986912 and the like disclose a coin receiving and dispensing machine constituted so as to sort deposited coins in accordance with their denominations, store them in coin storing boxes provided for the respective denominations and utilize coins stored in the coin storing boxes provided for the respective denominations for dispensation.

This coin receiving and dispensing machine is constituted so as to discriminate the genuineness and the denomination of coins deposited via a coin receiving and dispensing opening, to count their values, to temporarily store the deposited coins in a temporary storing section, and to sort the deposited coins in accordance with their denominations, thereby storing them in coin storing boxes provided for the respective denominations when an operator issues a coin-receiving instruction. On the other hand, it is constituted so as to take out coins accommodated in the coin storing boxes provided for the respective denominations, thereby dispensing them via the coin receiving and dispensing opening when the operator issues a coin-dispensing instruction.

This coin receiving and dispensing machine is constituted so as to, when coins are deposited, discriminate the genuineness and denominations of the deposited coins, sort the deposited coins in accordance with their denominations and store them in the coin storing boxes provided for the respective denominations. Therefore, when coins stored in the coin storing boxes provided for the respective denominations are utilized for dispensation, it is unnecessary to discriminate the genuineness and denominations thereof and coins can be quickly dispensed without fail using coins stored in the coin storing boxes provided for the respective denominations.

However, in the case where coin storing boxes are provided for the respective denominations in the coin receiving and dispensing machine, the coin receiving and dispensing machine inevitably becomes large and the cost of the coin receiving and dispensing machine inevitably increases.

Further, since the number of coins to be deposited and the number of coins to be dispensed differ greatly between different denominations, coin storing boxes having different sizes have to be provided for the respective denominations. However, even if coin storing boxes having different sizes are provided for the respective denominations, unless an auxiliary coin storing box is provided for collecting coins which cannot be stored in any of the coin storing boxes, the operation of the coin receiving and dispensing machine has to be frequently stopped. On the other hand, in the case where an auxiliary coin storing box is provided for collecting coins which cannot be stored in any of the coin storing boxes, the coin receiving and dispensing machine inevitably becomes larger and cost of the coin receiving and dispensing machine inevitably increases.

In addition, in the case where a coin of a new denomination is issued, it is extremely difficult in this coin receiving and dispensing machine to secure a space for accommodating a coin storing box for storing coins of the new denomination and feeding out the stored coins for dispensation. On the other hand, if a space for accommodating a coin storing box for storing coins of a new denomination is reserved in advance, the coin receiving and dispensing machine inevitably becomes much larger. It is therefore difficult to prepare for the issue of coins of new denomination in the future.

SUMMARY OF THE INVENTION

It is therefore an object of the present invention is to provide a coin receiving and dispensing machine which can be made compact and low in cost and can easily receive and dispense coins of a newly issued denomination.

The above and other objects of the present invention can be accomplished by a coin receiving and dispensing machine comprising a coin receiving and dispensing opening through which coins can be deposited and dispensed, sensor means provided in a coin passage and adapted for discriminating whether coins are acceptable and denominations of coins and counting the coins of each denomination, a single coin storing box for storing acceptable coins, at least one coin storing means for storing coins to be dispensed, and control means for controlling overall operation of the coin receiving and dispensing machine, the control means being constituted so as to, prior to dispensation of coins, take out coins stored in the coin storing box, cause the sensor means to discriminate denominations of the coins taken out from the coin storing box and count the number of the coins for each denomination, and store a predetermined number of coins in the at least one coin storing means for each denomination based on the discrimination and counting done by the sensor means, the control means being further constituted so as to, when coins are to be dispensed, take out coins stored in the at least one coin storing means, cause the sensor means to discriminate denominations of coins taken out from the at least one coin storing means and count the number of the coins of each denomination, and feed the coins to the coin receiving and dispensing opening based on the discrimination and counting done by the sensor means, the control means furthermore being constituted so as to cause the sensor means to discriminate whether or not coins deposited through the coin receiving and dispensing opening are acceptable and denominations of coins discriminated to be acceptable and count the number of the coins of each denomination, and store the coins deposited through the coin receiving and dispensing opening in the coin storing box.

According to the present invention, since a coin receiving and dispensing machine includes a coin receiving and dispensing opening through which coins can be deposited and dispensed, sensor means provided in a coin passage and adapted for discriminating whether coins are acceptable and denominations of coins and counting the coins of each denomination, a single coin storing box for storing acceptable coins, at least one coin storing means for storing coins to be dispensed, and control means for controlling overall operation of the coin receiving and dispensing machine and the control means is constituted so as to, prior to dispensation of coins, take out coins stored in the coin storing box, cause the sensor means to discriminate denominations of the coins taken out from the coin storing box and count the number of the coins of each denomination, and store a predetermined number of coins in the at least one coin storing means for each denomination based on the discrimination and counting done by the sensor means, the control means being further constituted so as to, when coins are to be dispensed, take out coins stored in the at least one coin storing means, cause the sensor means to discriminate denominations of coins taken out from the at least one coin storing means and count the number of the coins of each denomination, and feed the coins to the coin receiving and dispensing opening based on the discrimination and counting done by the sensor means. The control means is further constituted so as to cause the sensor means to discriminate whether or not coins deposited through the coin receiving and dispensing opening are acceptable and denominations of coins discriminated to be acceptable and count the number of the coins of each denomination, and store the coins deposited through the coin receiving and dispensing opening in the coin storing box, whereby all coins except those to be dispensed and stored in the at least one coin storing means are stored in the single coin storing box. Therefore, since the coin receiving and dispensing machine is not provided with coin storing boxes each adapted for storing coins of one denomination, it is possible to make the coin receiving and dispensing machine small and markedly lower the cost of the coin receiving and dispensing machine.

Further, according to the present invention, since all coins except those to be dispensed and stored in the at least one coin storing means are stored in the single coin storing box and the coin receiving and dispensing machine is not provided with coin storing boxes each adapted for storing coins of one denomination, it is unnecessary to provide any auxiliary coin storing box for collecting coins which cannot be stored in any of the coin storing boxes. Therefore, it is possible to make the coin receiving and dispensing machine small and markedly reduce the cost of the coin receiving and dispensing machine.

Furthermore, according to the present invention, since all coins except those to be dispensed and stored in the at least one coin storing means are stored in the single coin storing box and the coin receiving and dispensing machine is not provided with coin storing boxes each adapted for storing coins of one denomination, it is possible to accommodate all of them in the coin storing box even if the number of deposited coins of any denomination becomes large. Therefore, since it is unnecessary to stop the operation of the coin receiving and dispensing machine in order to collect coins which can no longer be stored in the coin storing box, it is possible to markedly improve the efficiency of the coin receiving and dispensing machine.

Moreover, according to the present invention, since all coins except those to be dispensed and stored in the at least one coin storing means are stored in the single coin storing box and the coin receiving and dispensing machine is not provided with coin storing boxes each adapted for storing coins of one denomination, it is possible to simplify the structure of the coin receiving and dispensing machine and improve the durability of the coin receiving and dispensing machine.

Further, according to the present invention, in the case where coins of a new denomination are issued, it is unnecessary to secure a space for accommodating a coin storing box for storing the coins of the newly issued denomination and dispensing coins stored therein and the coins of the newly issued denomination can be received by and dispensed from the coin receiving and dispensing machine only by changing a control program of the control means, it is unnecessary to secure a space that at least initially servers no purpose in order to prepare for coins of a denomination to be newly issued. Therefore, it is possible to make the coin receiving and dispensing machine much smaller and, on the other hand, it is possible to easily prepare for issue of coins of a new denomination in the future.

In a preferred aspect of the present invention, the control means is constituted so as to store, prior to coin dispensation, in the at least one coin storing means coins whose value is equal to a maximum value of coins to be dispensed by one coin dispensing operation as one dispensed coin unit.

According to this preferred aspect of the present invention, since the control means is constituted so as to store, prior to coin dispensation, in the at least one coin storing means coins whose value is equal to the maximum value of coins to be dispensed by one coin dispensing operation as one dispensed coin unit, it is possible to reliably dispense coins having the value requested by a customer.

In a further preferred aspect of the present invention, the control means is constituted so as to select coins of individual denominations for constituting the one dispensed coin unit in such a manner that the total number of the coins is minimum, and store the one dispensed coin unit in the at least one coin storing means prior to coin dispensation.

According to this preferred aspect of the present invention, since the control means is constituted so as to select coins of individual denominations for the one dispensed coin unit in such a manner that the total number of the coins is minimum and store the one dispensed coin unit in the at least one coin storing means prior to coin dispensation, the number of coins taken out from the at least one coin storing means for dispensation can be reduced and, therefore, it is possible to markedly improve the efficiency of the coin receiving and dispensing machine.

In a further preferred aspect of the present invention, the control means is constituted so as to store two or more dispensed coin units of coins in the at least one coin storing means prior to coin dispensation.

According to this preferred aspect of the present invention, since the control means is constituted so as to store two or more dispensed coin units of coins in the at least one coin storing means prior to coin dispensation, it is unnecessary to replenish the at least one coin storing means with coins to be dispensed every time a coin dispensation is completed and, therefore, it is possible to markedly improve the coin dispensing efficiency of the coin receiving and dispensing machine.

In a further preferred aspect of the present invention, the control means is constituted so as to, after the coin dispensing operation, take out coins stored in the coin storing box, cause the sensor means to discriminate the denominations of the coins taken out from the coin storing box and count the number thereof for each denomination, and, based on the results of discrimination and counting done by the sensor means, replenish the at least one coin storing means with coins whose number of each denomination is equal to that of the dispensed coins.

According to this preferred aspect of the present invention, the control means is constituted so as to, after the coin dispensing operation, take out coins stored in the coin storing box, cause the sensor means to discriminate the denominations of the coins taken out from the coin storing box and count the number thereof for each denomination, and, based on the results of discrimination and counting done by the sensor means, replenish the at least one coin storing means with coins whose number of each denomination is equal to that of the dispensed coins, and, therefore, coins constituting one dispensed coin unit or two or more dispensed coin units are always stored in the at least one coin storing means. Therefore, since it is unnecessary to stop the coin dispensing operation in order to replenish the at least one coin storing means with coins to be dispensed, it is possible to markedly improve the coin dispensing efficiency of the coin receiving and dispensing machine.

In another preferred aspect of the present invention, the coin receiving and dispensing machine includes two or more coin storing means for storing coins to be dispensed and the control means is constituted so as to store coins constituting one dispensed coin unit in each of the two or more coin storing means prior to a coin dispensing operation, selectively take out coins from one of the two or more coin storing means, cause the sensor means to discriminate denominations of the coins taken out from one of the two or more coin storing means and count the number thereof for each denomination, and dispense the coins into the coin receiving and dispensing opening based on the results of discrimination and counting done by the sensor means.

According to this preferred aspect of the present invention, the coin receiving and dispensing machine includes two or more coin storing means for storing coins to be dispensed and the control means is constituted so as to store coins constituting one dispensed coin unit in each of the two or more coin storing means prior to a coin dispensing operation, selectively take out coins from one of the two or more coin storing means, cause the sensor means to discriminate denominations of the coins taken out from one of the two or more coin storing means and count the number thereof for each denomination, and dispense the coins into the coin receiving and dispensing opening based on the results of discrimination and counting done by the sensor means, and, therefore, coins can be dispensed only by selectively taking out coins constituting one dispensed coin unit from one of the two or more coin storing means and coins can be dispensed in a short time.

In a further preferred aspect of the present invention, the control means is constituted so as to store coins constituting two or more dispensed coin units in at least one of the two or more coin storing means prior to dispensing coins.

According to this preferred aspect of the present invention, since the control means is constituted so as to store coins constituting two or more dispensed coin units in at least one of the two or more coin storing means prior to dispensing coins, coins constituting one dispensed coin unit or two or more dispensed coin units are always stored in the two or more coin storing means. Therefore, since it is unnecessary to stop the coin dispensing operation in order to replenish the two or more coin storing means with coins to be dispensed, it is possible to markedly improve the coin dispensing efficiency of the coin receiving and dispensing machine.

In a further preferred aspect of the present invention, the coin receiving and dispensing machine further includes a coin cassette provided at one of a front section and a rear section in a main body for accommodating coins and the coin cassette is adapted for accommodating coins to be stored in the coin storing box and the control means is adapted for, prior to a receiving operation and dispensing operation of coins, taking out coins accommodated in the coin cassette, causing the sensor means to discriminate whether or not the coins taken out from the coin cassette are acceptable and the denomination thereof and count the number thereof for each denomination, and storing, based on the results of discrimination and counting by the sensor means, coins discriminated by the sensor means to be acceptable in the coin storing box.

According to this preferred aspect of the present invention, since the coin receiving and dispensing machine further includes a coin cassette provided at one of a front section and a rear section in a main body for accommodating coins and the coin cassette is adapted for accommodating coins to be stored in the coin storing box and the control means is adapted for, prior to a receiving operation and dispensing operation of coins, taking out coins accommodated in the coin cassette, causing the sensor means to discriminate whether or not the coins taken out from the coin cassette are acceptable and the denomination thereof and count the number thereof for each denomination, and storing, based on the results of discrimination and counting by the sensor means, coins discriminated by the sensor means to be acceptable in the coin storing box, it is possible to easily charge coins used for dispensation in the coin storing box by accommodating coins to be accommodated in the coin receiving and dispensing machine in the coin cassette and mounting the coin cassette on the coin receiving and dispensing machine prior to starting daily business.

In a further preferred aspect of the present invention, the coin receiving and dispensing machine further includes a transporting belt for transporting coins taken out from the coin cassette and the coin storing box and the transporting belt is constituted so as to temporarily hold coins deposited through the coin receiving and dispensing opening and discriminated by the sensor unit to be acceptable.

In a further preferred aspect of the present invention, the control means is constituted so as to take out the coins stored in the at least one coin storing means and the coins stored in the coin storing box, cause the sensor means to discriminate whether or not the coins taken out from the at least one coin storing means and the coins taken out from the coin storing box are acceptable and the denominations thereof when they are acceptable and count the number thereof for each denomination, and accommodate coins discriminated to be acceptable in the coin cassette.

According to this preferred aspect of the present invention, since the control means is constituted so as to transfer coins accommodated in the coin cassette and the at least one coin storing means into the coin storing box to be stored therein, take out the coins stored in the coin storing box, cause the sensor means to discriminate whether or not the coins taken out from the coin storing box are acceptable and the denominations thereof when they are acceptable and count the number thereof for each denomination, and accommodate coins discriminated to be acceptable in the coin cassette, when daily business is completed, it is possible to easily collect all coins accommodated in the coin receiving and dispensing machine by accommodating them in the coin cassette detachably mounted on the coin receiving and dispensing machine.

In a further preferred aspect of the present invention, the coin receiving and dispensing machine further includes an unacceptable coin collecting box accessible from the outside and adapted for storing unacceptable coins and the control means is constituted so as to collect coins discriminated by the sensor means to be not acceptable in the unacceptable coin collecting box.

The above and other objects and features of the present invention will become apparent from the following description made with reference to the accompanying drawings.

DESCRIPTION OF THE PREFERRED EMBODIMENT

Figure 1:
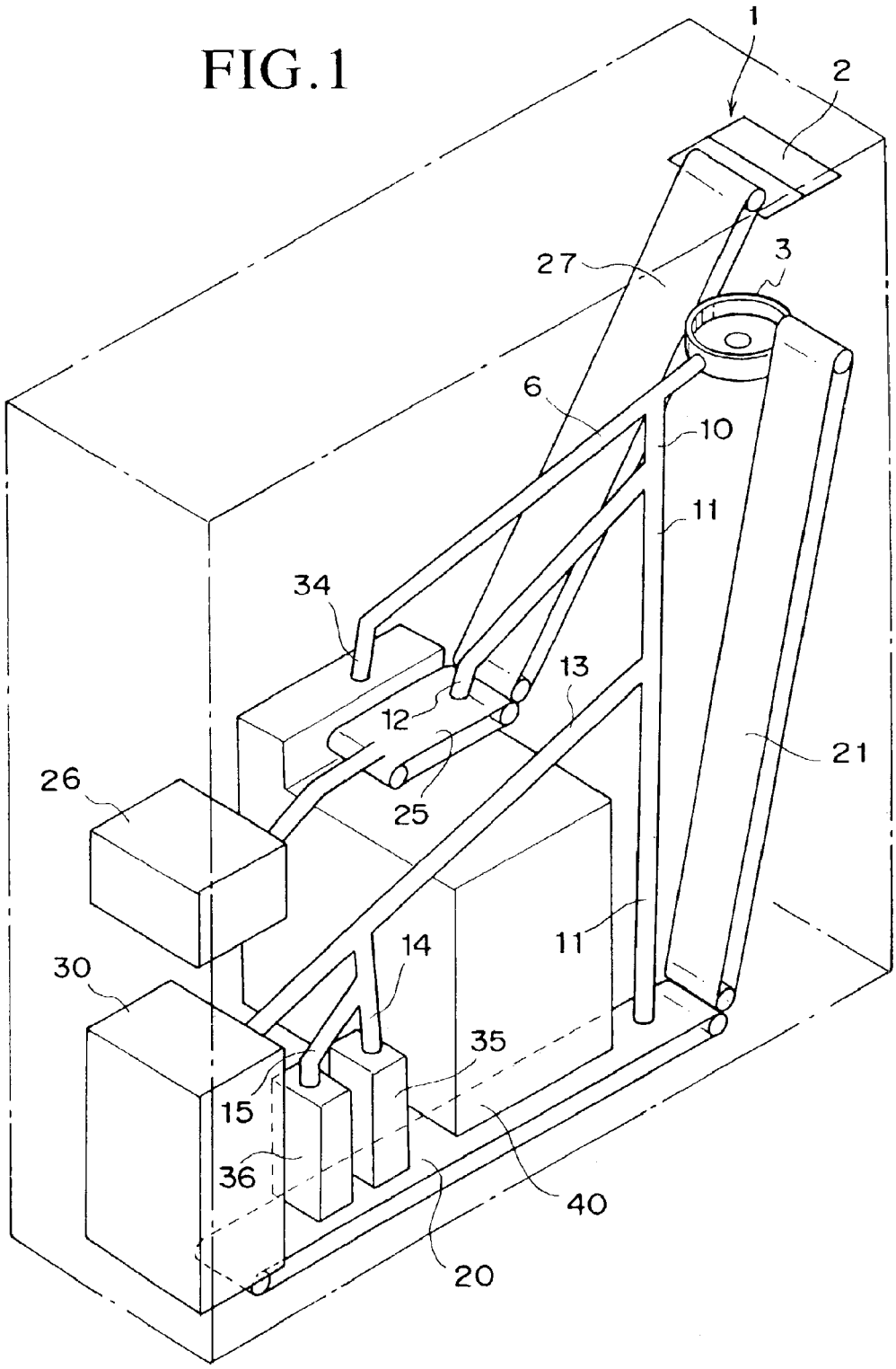
FIG. 1 is a schematic perspective view showing the internal mechanism of a coin receiving and dispensing machine which is a preferred embodiment of the present invention.
Figure 2:
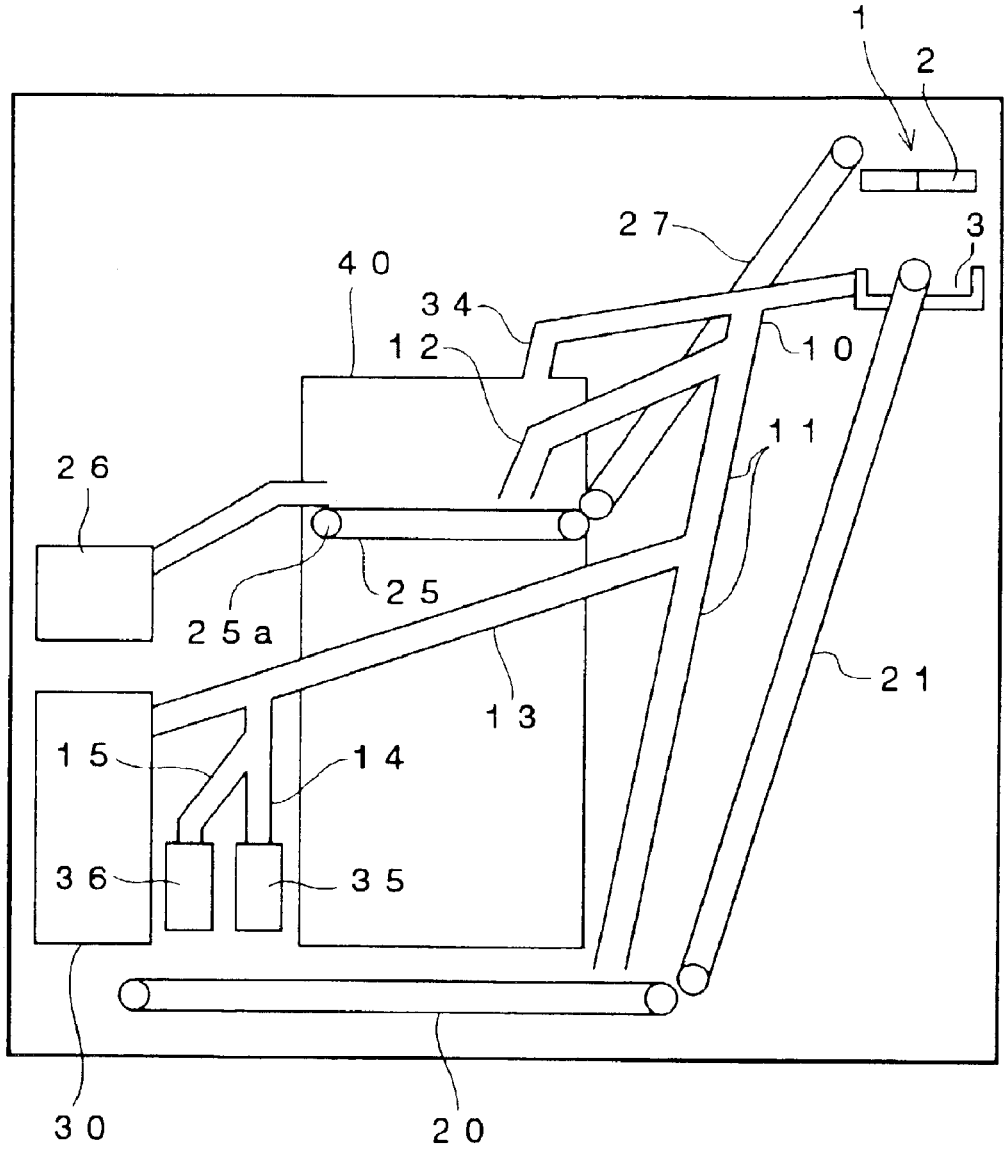
FIG. 2 is a schematic long-side view of the coin receiving and dispensing machine shown in FIG. 1.
Figure 3:
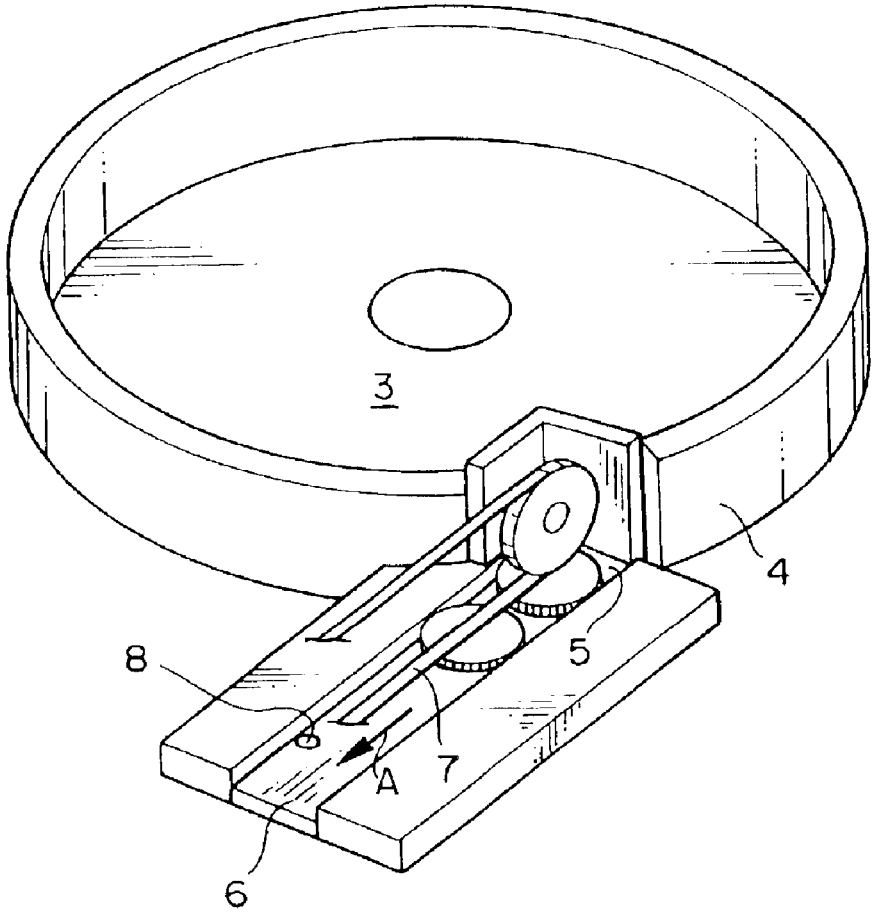
FIG. 3 is a schematic partial enlarged view showing details in the vicinity of a rotatable disk.

FIG. 1 is a schematic perspective view showing the internal mechanism of a coin receiving and dispensing machine which is a preferred embodiment of the present invention and FIG. 2 is a schematic long-side view of the coin receiving and dispensing machine shown in FIG. 1. FIG. 3 is a schematic partial enlarged view showing details in the vicinity of the rotatable disk.

As shown in FIGS. 1 to 3, the coin receiving and dispensing machine according to this embodiment includes a coin receiving and dispensing opening 1 formed on a top wall in the vicinity of a side portion of a main body and through which coins are deposited into and dispensed from the coin receiving and dispensing machine, and the bottom portion of the coin receiving and dispensing opening 1 is formed by a shutter 2.

Below the coin receiving and dispensing opening 1, a rotatable disk 3 is disposed for receiving coins dropping from the coin receiving and dispensing opening 1 on the upper surface thereof.

As shown in FIG. 3, a ring-like guide 4 is fixed at a portion immediately outside the circumference of the rotatable disk and is formed with a slot 5 having a gap larger than the thickness of the thickest coin among coins to be handled and smaller than double the thickness of the thinnest coin. Coins dropped from the coin receiving and dispensing opening 1 onto the rotatable disk 3 are pushed against the inner surface of the ring-like guide 4 by a centrifugal force produced by the rotation of the rotatable disk 3 and fed one by one along the inner surface of the ring-like guide 4 into a coin passage 6 via the slot 5.

As shown in FIGS. 1 to 3, the coin passage 6 is connected to the slot 5 and a transporting belt 7 is provided in the coin passage 6 for pressing coins onto the upper surface of the coin passage 6 and transporting them in the direction indicated by an arrow A.

In the coin passage 6, there are further provided a sensor unit 8 including an optical sensor for detecting optical properties of coins such as diameters, surface patterns thereof and the like, and a magnetic sensor for detecting magnetic properties of coins. Detection data of coins detected by the sensor unit 8 are output to a control unit (not shown) described later and it is discriminated by the control unit whether a coin deposited through the coin receiving and dispensing opening 1 is a currently circulated genuine coin whose damage level is equal to or lower than a reference damage level or the coin is an unacceptable coin such as a counterfeit coin, a foreign coin or a damaged coin whose damage level is higher than the reference damage level, namely, whether or not the coin is acceptable, and the number of coins deposited through the coin receiving and dispensing opening 1 is counted for each denomination.

A coin sorting device 9 is provided in the coin passage 6 downstream of the sensor unit 8.

Figure 4:
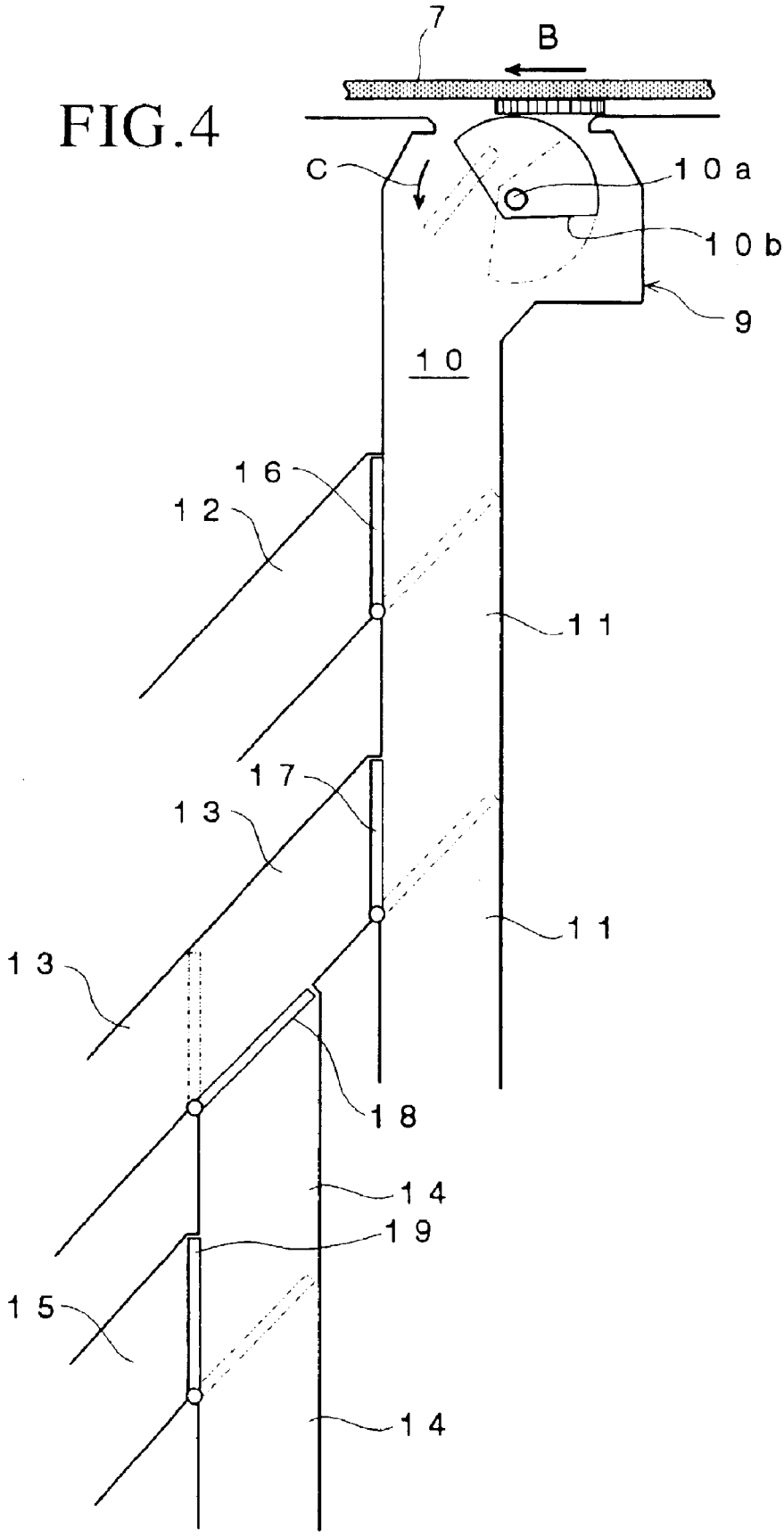
FIG. 4 is a schematic cross-sectional view showing a coin sorting device.

FIG. 4 is a schematic cross-sectional view showing the coin sorting device 9.

As shown in FIG. 4, the coin sorting device 9 is connected to the lower surface of the coin passage 6 so as to be substantially perpendicular to the coin passage 6 and includes a coin sorting passage 10 through which coins can be dropped and a sorting roller 10*b* swingably supported by a shaft 10*a* and having the shape of a sector cut from a cylinder.

The sorting roller 10*b* is held at a position indicated by a solid line in FIG. 4 to allow a coin to pass by in the direction indicated by the arrow B without dropping it into the coin sorting passage 10 and is swung from the position indicated by the solid line to the position indicated by the broken line to open the coin sorting passage 10 and allow the coin to drop into the coin sorting passage 10 as indicated by an arrow C.

As shown in FIG. 4, the coin sorting passage 10 is bifurcated into a first chute 11 communicating with a coin receiving and dispensing belt 20 described later and a second chute 12 communicating with a coin dispensing belt 25 described later and a third chute 13 communicating with a coin cassette 30 described later branches off from the first chute 11.

Further, a fourth chute 14 communicating with a first coin storing cylinder 35 for storing coins to be dispensed branches off from the third chute 13 communicating with the coin cassette 30 and a fifth chute 15 communicating with a second coin storing cylinder 36 for storing coins to be dispensed branches off from the fourth chute 14.

A first gate member 16 is swingably provided at the branch point of the first chute 11 and the second chute 12 for selectively leading coins to the coin receiving and dispensing belt 20 or the coin dispensing belt 25 and a second gate member 17 is swingably provided at the branch point of the first chute 11 and the third chute 13 for selectively leading coins to the coin receiving and dispensing belt 20, or the coin cassette 30, the first coin storing cylinder 35 or the second coin storing cylinder 36.

Further, a third gate member 18 is swingably provided at the branch point of the third chute 13 and the fourth chute 14 for selectively leading coins to the coin cassette 30, or the first coin storing cylinder 35 or the second coin storing cylinder 36 and a fourth gate member 19 is swingably provided at the branch point of the fourth chute 14 and the fifth chute 15 for selectively leading coins to the first coin storing cylinder 35 or the second coin storing cylinder 36.

The first gate member 16 is normally held at a position where the coin sorting passage 10 and the first chute 11 communicate with each other and the second gate member 17 is normally held at a position where the coin sorting passage 10 and the coin receiving and dispensing belt 20 communicate with each other via the first chute 11.

Further, the third gate member 18 is normally held at a position where the first chute 11 and the coin cassette 30 communicate with each other via the third chute 13 and the fourth gate member 19 is normally held at a position where the third chute 13 and the first coin storing cylinder 35 communicate with each other via the fourth chute 14.

As shown in FIGS. 1 and 2, the first chute 11 is constituted so as to lead coins onto the coin receiving and dispensing belt 20 extending in the longitudinal direction of the coin receiving and dispensing machine and at the downstream end portion of the coin receiving and dispensing belt 20, a coin lift belt 21 is provided for receiving coins from the coin receiving and dispensing belt 20 and feeding the thus received coins onto the rotatable disk 3.

The coin lift belt 21 is formed with cross pieces (not shown) for holding coins to be lifted above the rotatable disk 3 disposed at an upper portion of the coin receiving and dispensing machine.

As shown in FIGS. 1 and 2, the second chute 12 is constituted so as to lead coins onto the coin dispensing belt 25 extending in the longitudinal direction of the coin receiving and dispensing machine and wound around pulleys 25*a*, 25*a* and the end portion of the coin dispensing belt 25 on the rear side of the coin receiving and dispensing machine is connected to a coin collecting box 26 for collecting unacceptable coins such as counterfeit coins, foreign coins, damaged coins whose damage level is higher than the reference damage level and coins left at the coin receiving and dispensing opening without being collected by the operator.

On the other hand, a coin lift belt 27 for receiving coins from the coin dispensing belt 25 and transporting the received coins to the coin receiving and dispensing opening 1 is connected to the end portion of the coin dispensing belt 25 on the front side of the coin receiving and dispensing machine. The coin lift belt 27 is constituted so as to hold a coin on the surface thereof by a frictional force produced between the coin and the surface thereof and transport it to the coin receiving and dispensing opening 1.

The pulleys 25*a*, 25*a* around which the coin dispensing belt 25 is wound are constituted so as to be selectively rotated in forward or reverse direction and when a coin is to be transported to the coin collecting box 26, the pulleys 25*a*, 25*a* are rotated counterclockwise in FIG. 2. On the other hand, when a coin is to be fed to the coin receiving and dispensing opening 1, the pulleys 25*a*, 25*a* are rotated clockwise in FIG. 2.

As shown in FIGS. 1 and 2, the third chute 13 is constituted so as to lead coins into the coin cassette 30.

The coin cassette 30 is detachably mounted at the rear portion of the coin receiving and dispensing machine.

The coin cassette 30 serves as a safe and when daily business is started, the coin cassette 30 is mounted on the coin receiving and dispensing machine so that coins accommodated in the coin cassette 30 are fed into the coin receiving and dispensing machine from the coin cassette 30. On the other hand, when daily business is completed, coins accommodated in the coin receiving and dispensing machine are collected in the coin cassette 30 and the coin cassette 30 is removed from the coin receiving and dispensing machine.

A coin take-out means (not shown) is provided at a lower portion of the coin cassette 30 for taking out coins accommodated in the coin cassette 30 one by one onto the coin receiving and dispensing belt 20.

As shown in FIGS. 1 and 2, a sixth chute 34 is connected to the terminal end portion of the coin passage 6 and all coins passing through the coin passage 6 are fed to a coin storing box 40 disposed at a substantially central portion of the coin receiving and dispensing machine via the sixth chute 34 irrespective of their denominations, thereby being stored in the coin storing box 40.

At a lower portion of the coin storing box 40, a coin take-out means (not shown) is provided for taking out coins accommodated in the coin storing box 40 one by one onto the coin receiving and dispensing belt 20.

Figure 5:
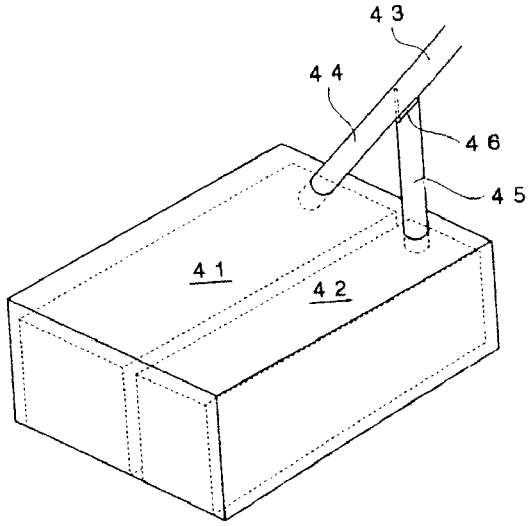
FIG. 5 is a schematic perspective view showing details in the vicinity of a coin collecting box.

FIG. 5 is a schematic perspective view showing details in the vicinity of the coin collecting box 26.

As shown in FIG. 5, the coin collecting box 26 includes an unacceptable coin collecting box 41 for collecting unacceptable coins such as counterfeit coins, foreign coins, damaged coins whose damage level is higher than the reference damage level and the like and left-behind coin storing box 42 for collecting coins which were dispensed to the coin receiving and dispensing opening 1 but were left there without being collected by the operator and a coin collecting passage 43 is connected to the terminal end portion of the coin dispensing belt 25.

The coin collecting passage 43 is bifurcated into a seventh chute 44 and a eighth chute 45 and the seventh chute 44 communicates with the unacceptable coin collecting box 41, while the eighth chute 45 communicates with the left-behind coin storing box 42.

At the branch point of the seventh chute 44 and the eighth chute 45, a fifth gate member 46 is swingably provided for selectively leading coins into the unacceptable coin collecting box 41 or the left-behind coin storing box 42.

The fifth gate member 46 is normally held at a position where the coin collecting passage 43 communicates with the unacceptable coin collecting box 41 via the seventh chute 44.

Although not shown in FIGS. 1 and 2, a coin take-out means is provided at a lower portion of the first coin storing cylinder 35 for taking out coins stored in the first coin storing cylinder 35 one by one onto the coin receiving and dispensing belt 20 and a coin take-out means is provided at a lower portion of the second coin storing cylinder 36 for taking out coins stored in the second coin storing cylinder 36 one by one onto the coin receiving and dispensing belt 20.

Figure 6:
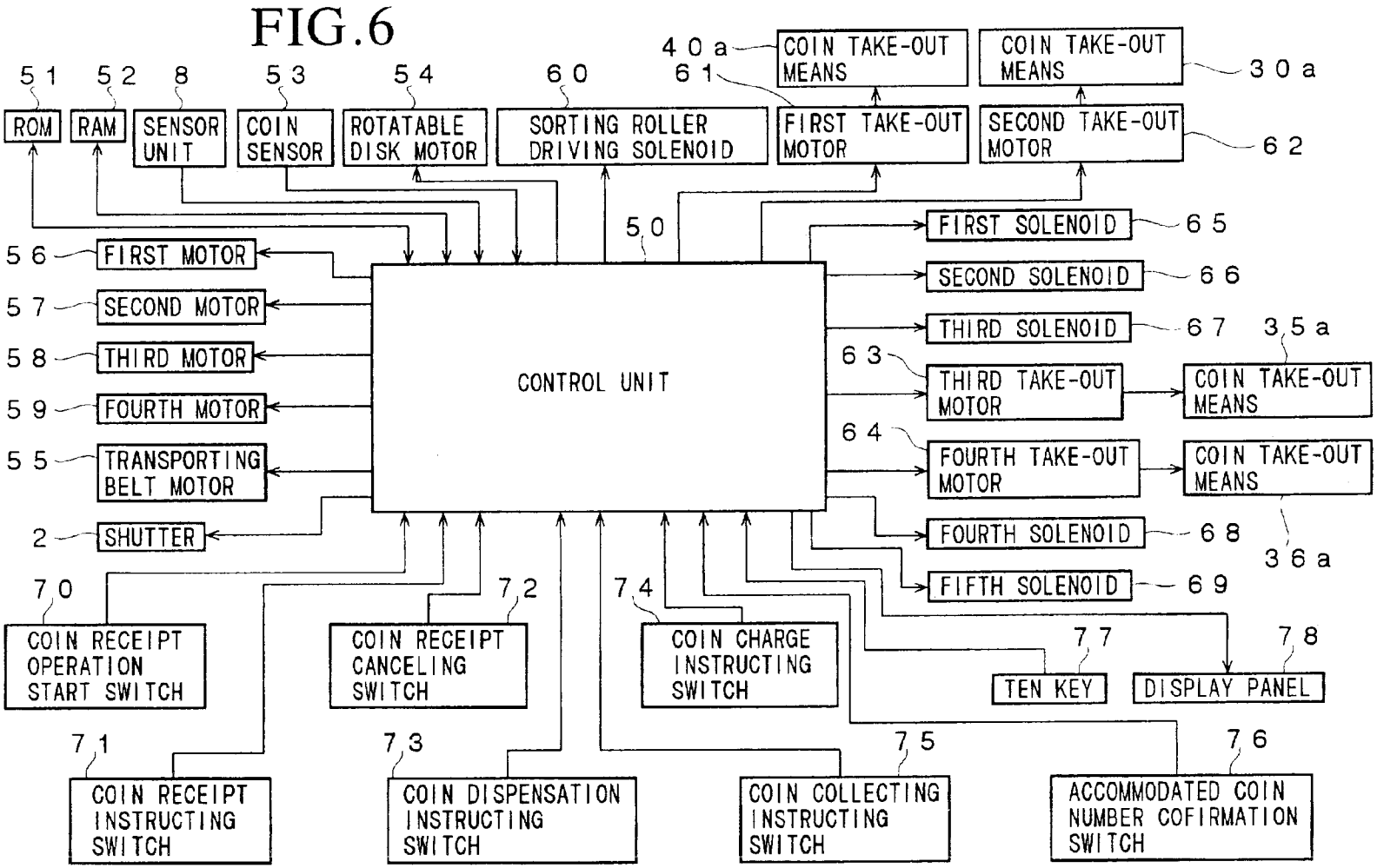
FIG. 6 is a block diagram of a control system, detection system, drive system, input system and display system of a coin receiving and dispensing machine which is a preferred embodiment of the present invention.

FIG. 6 is a block diagram of a control system, detection system, drive system, input system and display system of the coin receiving and dispensing machine which is a preferred embodiment of the present invention.

As shown in FIG. 6, the control system of the coin receiving and dispensing machine according to this embodiment includes a control unit 50 for controlling an overall operation of the coin receiving and dispensing machine, a ROM 51 for storing a control program, reference diameter data, reference surface pattern data, reference magnetic data, reference damage level data of coins for each denomination and the like, and a RAM 52.

As shown in FIG. 6, the detection system of the coin receiving and dispensing machine according to this embodiment includes the sensor unit 8 including an optical sensor for detecting optical properties of coins, such as diameters, surface patterns thereof and the like, and a magnetic sensor for detecting magnetic properties of coins and adapted for outputting detection signals to the control unit 50; and a coin sensor 53 for detecting that a coin has reached the coin sorting device 9 provided in the coin passage 6 and outputting a coin detection signal to the control unit 50.

As shown in FIG. 6, the drive system of the coin receiving and dispensing machine according to this embodiment includes the shutter 2, a rotatable disk motor 54 for rotating the rotatable disk 3, a transporting belt motor 55 for driving the transporting belt 7, a first motor 56 for driving the coin receiving and dispensing belt 20, a second motor 57 for driving the coin lift belt 21, a third motor 58 for selectively rotating the pulleys 25*a*, 25*a* of the coin dispensing belt 25 in a forward or reverse direction, a fourth motor 59 for driving the coin lift belt 27, a sorting roller driving solenoid 60 for driving the sorting roller 10*b*, a first take-out motor 61 for driving a coin take-out means 40*a* provided at a lower portion of the coin storing box 40, a second take-out motor 62 for driving a coin take-out means 30*a* provided at a lower portion of the coin cassette 30, a third take-out motor 63 for driving a coin take-out means 35*a* provided at a lower portion of the first coin storing cylinder 35, a fourth take-out motor 64 for driving a coin take-out means 36*a* provided at a lower portion of the second coin storing cylinder 36, a first solenoid 65 for driving the first gate member 16, a second solenoid 66 for driving the second gate member 17, a third solenoid 67 for driving the third gate member 18, a fourth solenoid 68 for driving the fourth gate member 19 and a fifth solenoid 69 for driving the fifth gate member 46.

As shown in FIG. 6, the input system of the coin receiving and dispensing machine according to this embodiment includes a coin receipt operation start switch 70, a coin receipt instructing switch 71 for entering an instruction to receive coins, a coin receipt canceling switch 72 for entering an instruction to cancel receipt of coins, a coin dispensation instructing switch 73 for entering an instruction to dispense coins, a coin charge instructing switch 74 for entering an instruction to charge coins accommodated in the coin cassette 30 into the coin receiving and dispensing machine, a coin collecting instructing switch 75 for entering an instruction to collect coins accommodated in the coin receiving and dispensing machine into the coin cassette 30, an accommodated coin number confirmation switch 76 for entering an instruction to confirm the number of coins accommodated in the coin receiving and dispensing machine for each denomination, and a ten key pad 77 through which the value of coins to be dispensed can be input.

As shown in FIG. 6, the display system of the coin receiving and dispensing machine according to this embodiment includes a display panel 78 constituted by a liquid crystal display panel, an organic EL panel or the like.

The thus constituted coin receiving and dispensing machine according to this embodiment is installed and used together with a bill receiving and dispensing machine and coins are accommodated from the coin cassette 30 into the coin receiving and dispensing machine.

Figure 7:
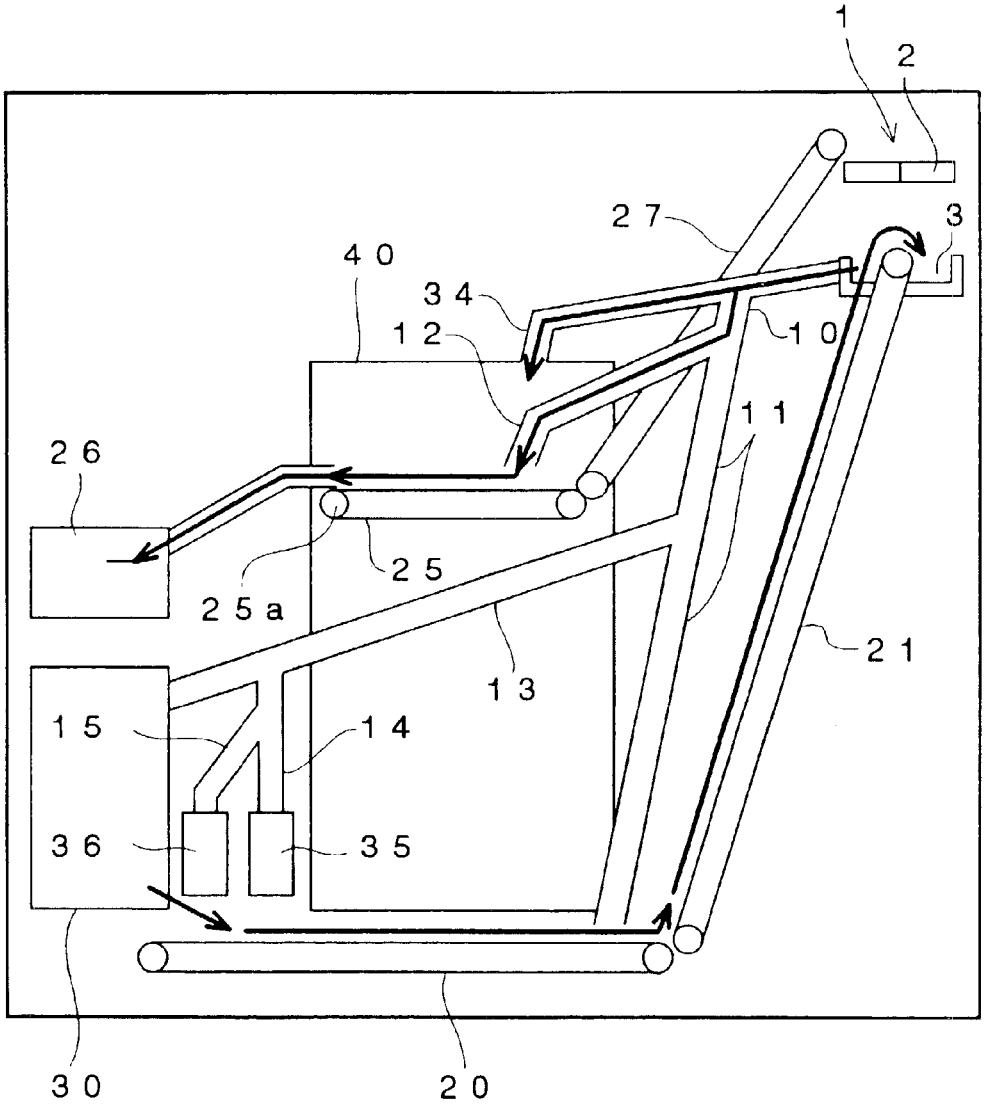
FIG. 7 is a schematic long-side cross-sectional view of a coin receiving and dispensing machine for showing a coin charging process for charging coins from a coin cassette mounted on a rear portion of a main body into the coin receiving and dispensing machine.

FIG. 7 is a schematic long-side cross-sectional view of the coin receiving and dispensing machine for showing a coin charging process for charging coins from the coin cassette 30 mounted on the rear portion of the main body into the coin receiving and dispensing machine.

The coin cassette 30 accommodating coins is first mounted on the coin receiving and dispensing machine and the coin charge instructing switch 74 is operated.

When the coin charge instructing switch 74 is operated, a coin charge instructing signal is input to the control unit 50.

When the coin charge instructing signal is input, the control unit 50 outputs drive signals to the first motor 56, the second motor 57, the rotatable disk motor 54 and the transporting belt motor 55 and also outputs a reverse rotation signal to the third motor 58.

As a result, the transporting belt 7, the coin receiving and dispensing belt 20 and the coin lift belt 21 are driven and the rotatable disk 3 is rotated. Further, the pulleys 25*a*, 25*a* around which the coin dispensing belt 25 is wound are rotated counterclockwise.

The control unit 50 then outputs a drive signal to the second take-out motor 62, thereby causing the coin take-out means 30*a* provided at a lower portion of the coin cassette 30 to take out coins accommodated in the coin cassette 30 one by one onto the coin receiving and dispensing belt 20.

Coins taken out from the coin cassette 30 onto the coin receiving and dispensing belt 20 are delivered from the coin receiving and dispensing belt 20 onto the coin lift belt 21 and fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and sequentially fed out into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of the discrimination in a discrimination result memory area of the RAM 52. Further, the control unit 50 counts the number of coins for each denomination and writes the number of coins in a coin number memory area of the RAM 52.

The coin is further transported downstream in the coin passage 6 by the transporting belt 7 and when the coin is detected by the coin sensor 53 provided in the coin passage 6 in the vicinity of the coin sorting device 9, a coin detection signal is output to the control unit 50.

When the control unit 50 receives the coin detection signal, it reads out the result of the discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive signal to the sorting roller driving solenoid 60 to cause it to swing the sorting roller 10*b*, thereby opening the coin sorting passage 10 and outputs a drive signal to the first solenoid 65 for driving the first gate member 16, thereby causing it to swing the first gate member 16 to a position where the coin sorting passage 10 and the second chute 12 communicate with each other.

As a result, the coin is dropped into the coin sorting passage 10 and led from the coin sorting passage 10 to the second chute 12, thereby being fed onto the coin dispensing belt 25.

To the contrary, when the coin was discriminated to be an acceptable coin which is a currently circulated genuine coin whose damage level is equal to or lower than the reference level, the control unit 50 outputs no signal.

As a result, the coin discriminated to be an acceptable coin which is a currently circulated genuine coin whose damage level is equal to or lower than the reference level passes through the coin sorting device 9 and is fed into the coin storing box 40 via the sixth chute 34 connected to the terminal end portion of the coin passage 6 to be stored therein.

The unacceptable coin fed onto the coin dispensing belt 25 is fed toward the coin collecting box 26 since the reverse rotation signal was output to the third motor 58 and the pulleys 25*a*, 25*a* around which the coin dispensing belt 25 is wound are rotated counterclockwise in FIG. 2.

The unacceptable coin is fed from the coin dispensing belt 25 to the coin collecting passage 43 and collected in the unacceptable coin collecting box 41 since the fifth gate member 46 is held at a position where the coin collecting passage 43 and the unacceptable coin collecting box 41 communicate with each other.

When all coins accommodated in the coin cassette 30 have been fed into the coin storing box 40 or the unacceptable coin collecting box 41 and accommodated therein in this manner, the control unit 50 outputs drive stop signals to the first motor 56, the second motor 57, the third motor 58, the rotatable disk motor 54, the transporting belt motor 55 and the second take-out motor 62, thereby stopping the transporting belt 7, the coin receiving and dispensing belt 20, the coin dispensing belt 25, the coin lift belt 21, the coin take-out means 30*a* provided at a lower portion of the coin cassette 30 and the rotation of the rotatable disk 3, thus completing the coin charging process.

As a result, the number of coins accommodated in the coin storing box 40 of the coin receiving and dispensing machine is stored for each denomination in the coin number memory area of the RAM 52.

In this embodiment, since coins to be dispensed are stored in the first coin storing cylinder 35 and the second coin storing cylinder 36, prior to starting daily business, a dispensed coin accommodating process is first conducted for the first coin storing cylinder 35 and the second coin storing cylinder 36 and coins to be dispensed are fed from the coin storing box 40 to the first coin storing cylinder 35 and the second coin storing cylinder 36 to be stored therein.

Therefore, when all coins accommodated in the coin cassette 30 have been fed into the coin storing box 40 or the unacceptable coin collecting box 41 and accommodated therein and the coin charging process has been completed, the control unit 50 transfers coins to be dispensed from the coin storing box 40 to the first coin storing cylinder 35 and the second coin storing cylinder 36 to be stored therein.

Since the coin receiving and dispensing machine is constituted so as to be provided together with a bill receiving and dispensing machine, the maximum value of coins to be dispensed from the coin receiving and dispensing machine by one coin dispensing operation is equal to the value obtained by subtracting the value of the smallest denomination coin among coins currently in circulation from the value of the smallest denomination bill among bills currently in circulation. Therefore, in the coin receiving and dispensing machine according to this embodiment, coins whose total value is equal to the maximum value of coins to be dispensed by one coin dispensing operation is determined as a dispensed coin unit U and one dispensed coin accommodating process transfers coins constituting one dispensed coin unit U from the coin storing box 40 to the first coin storing cylinder 35 and the second coin storing cylinder 36 to be stored therein.

When the coin receiving and dispensing machine is used in Japan, for example, since the smallest denomination bill among bills currently in circulation is the 1000 yen bill and the smallest denomination coin among coins currently in circulation is the 1 yen coin, 999 yen is determined as one dispensed coin unit U.

Although a combination of two or more different denominations of coins may be determined as one dispensed coin unit U in the case where two or more denominations of coins are in circulation, the number of different denominations of coins is determined for one dispensed coin unit U so that the total number is minimum in this embodiment.

For example, since 1 yen coins, 5 yen coins, 10 yen coins, 50 yen coins, 100 yen coins and 500 yen coins are circulated in Japan, when the coin receiving and dispensing machine is used in Japan, one dispensed coin unit U is constituted by one 500 yen coin, four 100 yen coins, one 50 yen coin, four 10 yen coins, one 5 yen coin and four 1 yen coins.

In the case where the coin receiving and dispensing machine is provided with only one coin storing cylinder for storing coins to be dispensed and only coins constituting one dispensed coin unit U are stored in the coin storing cylinder, it is indispensable to conduct the dispensed coin accommodating process every time coins have been dispensed and it is impossible to receive coins while the dispensed coin accommodating process is being conducted. On the other hand, in the case where coins constituting two or more dispensed coin units U are stored in the coin storing cylinder, the number of coins required to be taken out from the coin storing cylinder increases for dispensation of coins and it may take a long time for the coin dispensing operation. Therefore, this embodiment is provided with the first coin storing cylinder 35 and the second coin storing cylinder 36 and each accommodates coins constituting one dispensed coin unit U.

Figure 8:
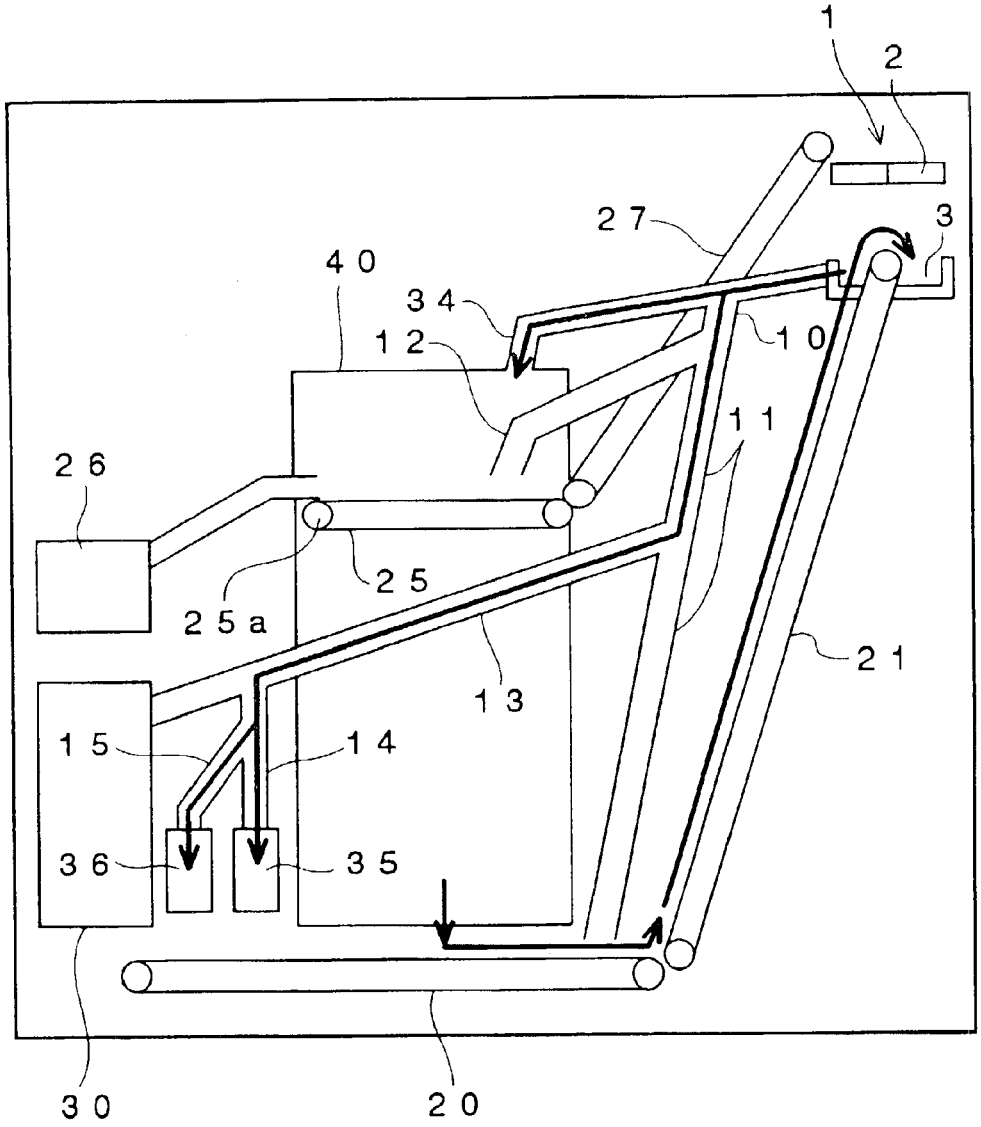
FIG. 8 is a schematic long-side cross-sectional view of a coin receiving and dispensing machine for showing a dispensed coin accommodating process for accommodating coins to be dispensed from a coin storing box into a first coin storing cylinder and a second coin storing cylinder.

FIG. 8 is a schematic long-side cross-sectional view of the coin receiving and dispensing machine for showing the dispensed coin accommodating process for accommodating coins to be dispensed from the coin storing box 40 into the first coin storing cylinder 35 and the second coin storing cylinder 36.

When all coins accommodated in the coin cassette 30 have been fed into the coin storing box 40 or the unacceptable coin collecting box 41 and accommodated therein and the coin charging process has been completed, the control unit 50 first outputs drive signals to the sorting roller driving solenoid 60 and the second solenoid 67, thereby swinging the sorting roller 10*b* from the position indicated by the solid line to the position indicated by the broken line in FIG. 4 to open the coin sorting passage 10 and driving the second gate member 17 and the third gate member 18 so that the coin sorting passage 10 communicates with the fourth chute 14.

The control unit 50 then outputs drive signals to the first motor 56, the second motor 57, the rotatable disk motor 54 and the transporting belt motor 55.

As a result, the transporting belt 7, the coin receiving and dispensing belt 20 and the coin lift belt 21 are driven and the rotatable disk 3 is rotated.

The control unit 50 further outputs a drive signal to the first take-out motor 61, thereby causing the coin take-out means 40*a* provided at a lower portion of the coin storing box 40 to sequentially take out coins stored in the coin storing box 40 one by one onto the coin receiving and dispensing belt 20.

Coins taken out from the coin storing box 40 onto the coin receiving and dispensing belt 20 are delivered from the coin receiving and dispensing belt 20 onto the coin lift belt 21 and fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and sequentially fed out into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of discrimination in a discrimination result memory area of the RAM 52. Further, the control unit 50 counts the number of coins for each denomination and writes the number of coins in a first dispensable coin number memory area of the RAM 52. The first dispensable coin number memory area of the RAM 52 is adapted for storing the number of coins stored in the first coin storing cylinder 35 for each denomination.

The coin is further transported downstream in the coin passage 6 by the transporting belt 7 and when the coin is detected by the coin sensor 53 provided in the coin passage 6 in the vicinity of the coin sorting device 9, a coin detection signal is output to the control unit 50.

When the control unit 50 receives the coin detection signal, it reads out the result of discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive stop signal to the sorting roller driving solenoid 60 to cause it to return the sorting roller 10*b* to the position indicated by the solid line in FIG. 4, thereby closing the coin sorting passage 10.

As a result, the coin discriminated to be an unacceptable coin is further transported by the transporting belt 7 in the coin passage 6 and is accommodated in the coin storing box 40 via the sixth chute 34.

In this embodiment, the coin discriminated to be an unacceptable coin is not accommodated in the unacceptable coin collecting box 41 but accommodated in the coin storing box 40 because each of coins stored in the coin storing box 40 has already been discriminated to be an acceptable coin which is a currently circulated genuine coin whose damage level is equal to or lower than the reference damage level and there is a risk of it being erroneously discriminated to be unacceptable during the dispensed coin accommodating process for the first coin storing cylinder 35 and the second coin storing cylinder 36.

To the contrary, when the coin was discriminated to be an acceptable coin which is a currently circulated genuine coin whose damage level is equal to or lower than the reference level, the control unit 50 outputs no signal.

Therefore, the coin discriminated to be an acceptable coin which is a currently circulated genuine coin whose damage level is equal to or lower than the reference level is dropped into the coin sorting passage 10.

As a result, since the second gate member 17 and the third gate member 18 were driven and the fourth gate member 19 is held at a position where the third chute 13 and the first coin storing cylinder 35 communicate with each other via the fourth chute 14, the coin discriminated to be an acceptable coin which is a currently circulated genuine coin whose damage level is equal to or lower than the reference level passes through the third chute 13 and the fourth chute 14 and is accommodated in the first coin storing cylinder 35.

Every time the detection signals are input from the sensor unit 8, the control unit 50 discriminates whether the coin is acceptable and the denomination thereof and writes the result of the discrimination in the discrimination result memory area of the RAM 52. At the same time, the control unit 50 updates the number of coins of the discriminated denomination written in the first dispensable coin number memory area of the RAM 52.

Thus, when the number of coins of a certain denomination written in the first dispensable coin number memory area of the RAM 52 has become equal to the number of coins of the denomination to be included in one dispensed coin unit U, it follows that coins of the denomination whose number is equal to that to be included in one dispensed coin unit U have been already accommodated in the first coin storing cylinder 35. Therefore, when coins of the denomination is detected thereafter based on the detection signals input from the sensor unit 8, the control unit 50 counts the number of coins and writes the counted number in a second dispensable coin number memory area of the RAM 52. The second dispensable coin number memory area of the RAM 52 is adapted for storing the number of coins stored in the second coin storing cylinder 36 for each denomination.

The coin of the denomination is further transported by the transporting belt 7 downstream in the coin passage 6 and when the coin is detected by the coin sensor 53 provided in the coin passage 6 in the vicinity of the coin sorting device 9 and the coin detection signal is input from the coin sensor 53, the control unit 50 outputs a drive signal to the fourth solenoid 68 for driving the fourth gate member 19, thereby causing it to move the fourth gate member 19 to a position where the third chute 13 and the fifth chute 15 communicate with each other.

As a result, the coin of the same denomination as that of coins which have been already accommodated in the first coin storing cylinder 35 so that the number thereof is equal to that to be included in one dispensed coin unit U is dropped into the coin sorting passage 10 and fed into the second coin storing cylinder 36 via the first chute 11, the third chute 13, the fourth chute 14 and the fifth chute 15 to be stored therein.

On the other hand, when a coin of another denomination to be included in one dispensed coin unit U is detected by the sensor unit 8, the control unit 50 updates the number of coins of the denomination written in the first dispensable coin number memory area of the RAM 52 and feeds the coin to the first coin storing cylinder 35 via the first chute 11, the third chute 13 and the fourth chute 14 to be stored therein until the number of coins of the denomination written in the first dispensable coin number memory area of the RAM 52 becomes equal to the number of coins of the denomination to be included in one dispensed coin unit U When the number of coins of the denomination written in the first dispensable coin number memory area of the RAM 52 has become equal to the number of coins of the denomination to be included in one dispensed coin unit U, it follows that coins of the denomination whose number is equal to that to be included in one dispensed coin unit U have been already accommodated in the first coin storing cylinder 35. Therefore, when coins of the denomination is detected thereafter based on the detection signals input from the sensor unit 8, the control unit 50 counts the number of coins and writes the counted number in a second dispensable coin number memory area of the RAM 52.

The coin of the denomination is further transported by the transporting belt 7 downstream in the coin passage 6 and when the coin is detected by the coin sensor 53 provided in the coin passage 6 in the vicinity of the coin sorting device 9 and the coin detection signal is input from the coin sensor 53, the control unit 50 outputs a drive signal to the fourth solenoid 68 for driving the fourth gate member 19, thereby causing it to move the fourth gate member 19 to a position where the third chute 13 and the fifth chute 15 communicate with each other.

As a result, the coin of the same denomination as that of coins which have been already accommodated in the first coin storing cylinder 35 so that the number thereof is equal to that to be included in one dispensed coin unit U is dropped into the coin sorting passage 10 and fed into the second coin storing cylinder 36 via the first chute 11, the third chute 13, the fourth chute 14 and the fifth chute 15 to be stored therein.

Thus, when the number of coins of each denomination to be included in one dispensed coin unit U and written in the first dispensable coin number memory area of the RAM 52 has become equal to that of coins of the corresponding denomination to be included in one dispensed coin unit U, the control unit 50 completes the accommodation of coins into the first coin storing cylinder 35.

Further, when the number of coins of a certain denomination written in the second dispensable coin number memory area of the RAM 52 has become equal to the number of coins of the denomination to be included in one dispensed coin unit U, since it follows that coins of the denomination whose number is equal to that to be included in one dispensed coin unit U have been already accommodated in each of the first coin storing cylinder 35 and the second coin storing cylinder 36, the control unit 50 outputs a drive stop signal to the first take-out motor 61, thereby causing it to stop the coin take-out means 40*a* provided at a lower portion of the coin storing box 40.

When coins of each denomination to be included in one dispensed coin unit U have been accommodated in the second coin storing cylinder 36 and the coin take-out means been stopped, then, after all of those among the coins already taken out from the coin storing box 40 onto the coin receiving and dispensing belt 20 that follow the coins to be accommodated in the second storing cylinder 36 have been collected in the coin storing box 40, the control unit 50 outputs drive stop signals to the first motor 56, the second motor 57, the rotatable disk motor 54 and the transporting belt motor 55, thereby stopping the drive of the transporting belt 7, the coin receiving and dispensing belt 20, the coin lift belt 21 and the rotation of the rotatable disk 3 and further outputs a drive stop signal to the sorting roller driving solenoid 60 to cause it to return the sorting roller 10*b* to the position indicated by the solid line in FIG. 4, thereby closing the coin sorting passage 10. Thus, the dispensed coin accommodating processing of coins to be dispensed to the first coin storing cylinder 35 and the second coin storing cylinder 36 is completed.

When the dispensed coin accommodating processing of coins to be dispensed to the first coin storing cylinder 35 and the second coin storing cylinder 36 has been completed, since the number of coins accommodated in the first coin storing cylinder 35 and the second coin storing cylinder 36 has been stored for each denomination in the first dispensable coin number memory area and the second dispensable coin number memory area of the RAM 52, the coin receiving and dispensing machine is ready to receive coins and dispense coins.

Figure 9:
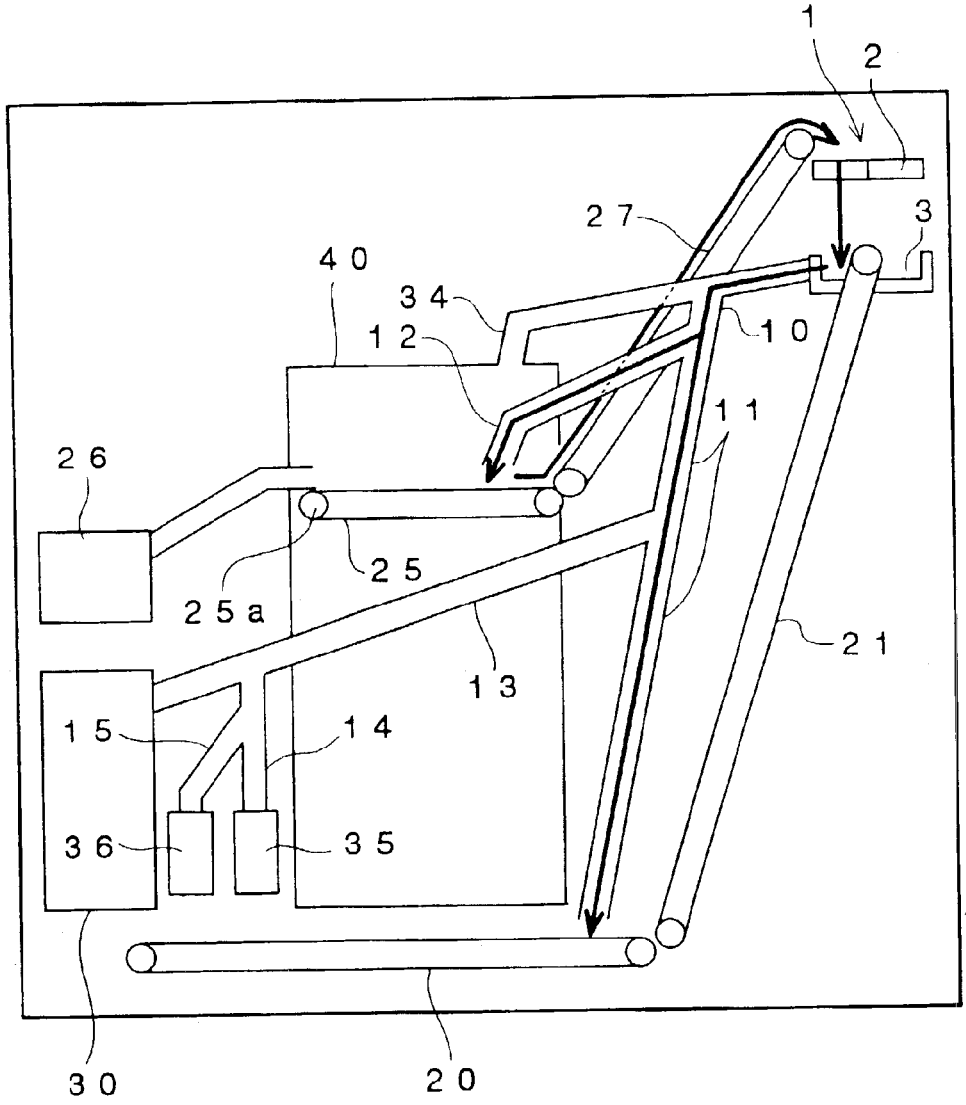
FIG. 9 is a schematic long-side cross-sectional view of a coin receiving and dispensing machine for showing a coin accommodating process for accommodating coins deposited via a coin receiving and dispensing opening into a coin storing box.

FIG. 9 is a schematic long-side cross-sectional view of the coin receiving and dispensing machine for showing a coin accommodating process for accommodating coins deposited via the coin receiving and dispensing opening 1 into the coin storing box 40.

When coins are to be received, the coins are deposited in the coin receiving and dispensing opening 1 by the operator and the coin receipt operation start switch 70 is operated.

When the coin receipt operation start switch 70 is operated, a coin receipt operation start signal is input to the control unit 50.

When the control unit 50 receives the coin receipt operation start signal, it first outputs a drive signal to the sorting roller driving solenoid 60 to cause it to swing the sorting roller 10*b* from the position indicated by a solid line in FIG. 4 to the position indicated by the broken line, thereby opening the coin sorting passage 10.

The control unit 50 then outputs drive signals to the rotatable disk motor 54, the transporting belt motor 55 and the fourth motor 59 and outputs a forward rotation signal to the third motor 58. Further, the control unit 50 outputs an opening signal to the shutter 2.

As a result, the rotatable disk 3 is rotated and the transporting belt 7 and the coin lift belt 27 are driven. Further, the pulleys 25*a*, 25*a* around which the coin dispensing belt 25 is wound are rotated clockwise in FIG. 2 and the shutter 2 of the coin receiving and dispensing opening 1 is opened, whereby coins deposited in the coin receiving and dispensing opening 1 are dropped onto the rotatable disk 3.

Then, the control unit 50 outputs a closing signal to the shutter 2, thereby closing the shutter 2 of the coin receiving and dispensing opening 1.

Coins dropped onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of discrimination in a discrimination result memory area of the RAM 52. Further, the control unit 50 counts the number of coins for each denomination and writes the number of coins in a received coin number memory area of the RAM 52.

The coin is further transported downstream in the coin passage 6 by the transporting belt 7 and when the coin is detected by the coin sensor 53 provided in the coin passage 6 in the vicinity of the coin sorting device 9, a coin detection signal is output to the control unit 50.

When the control unit 50 receives the coin detection signal, it reads out the result of discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive signal to the first solenoid 65 to cause it to move the first gate member 16 to a position where the coin sorting passage 10 and the second chute 12 communicate with each other.

As a result, the coin discriminated to be an unacceptable coin is dropped into the coin sorting passage 10 and passes through the second chute 12 to be fed onto the coin dispensing belt 25.

To the contrary, when the coin was discriminated to be an acceptable coin which is a currently circulated genuine coin whose damage level is equal to or lower than the reference level, the control unit 50 outputs no signal.

As a result, since the first gate member 16 is held at a position where the coin sorting passage 10 and the first chute 11 communicate with each other and the second gate member 17 is held at a position where the first chute 11 and the coin receiving and dispensing belt 20 communicate with each other, the coin discriminated to be an acceptable coin which is a currently circulated genuine coin whose damage level is equal to or lower than the reference level is dropped into the coin sorting passage 10 and passes through the first chute 11 to be fed onto the coin receiving and dispensing belt 20.

Coins fed onto the coin receiving and dispensing belt 20 are temporarily held thereon.

On the other hand, coins discriminated to be unacceptable and fed onto the coin dispensing belt 25 are transported by the coin dispensing belt 25 toward the coin receiving and dispensing opening 1 since the pulleys 25*a*, 25*a* around which the coin dispensing belt 25 is wound are rotated clockwise in FIG. 2 and they are delivered to the coin lift belt 27.

Coins delivered to the coin lift belt 27 are returned onto the shutter 2 of the coin receiving and dispensing opening 1.

Thus, when all coins deposited into the coin receiving and dispensing opening 1 have been fed out from the rotatable disk 3 and coins discriminated to be acceptable coins which are currently circulated genuine coins whose damage levels are equal to or lower than the reference damage level have been temporarily held on the coin receiving and dispensing belt 20, while coins discriminated to be unacceptable have been returned onto the shutter 2 of the coin receiving and dispensing opening 1, the control unit 50 outputs drive stop signals to the rotatable disk motor 54, the transporting belt motor 55, the third motor 58 and the sorting roller driving solenoid 60, thereby stopping the rotation of the rotatable disk 3 and the drive of the transporting belt 7 and the coin dispensing belt 25 and returning the sorting roller 10*b* to the position indicated by the solid line in FIG. 4 to close the coin sorting passage 10.

Then, the control unit 50 calculates the total value of the coins deposited in the coin receiving and dispensing opening 1 from the number of coins of each denomination written in the received coin number memory area of the RAM 52 and causes the display panel 78 to display the thus calculated total value of the coins and a message that the coin receipt instructing switch 71 should be operated if the coins are to be finally received, and the coin receipt canceling switch 72 should be operated if the receipt of coins is to be canceled.

When the coin receipt instructing switch 71 is operated thereafter by the operator, a coin receipt instructing signal is input to the control unit 50.

Figure 10:
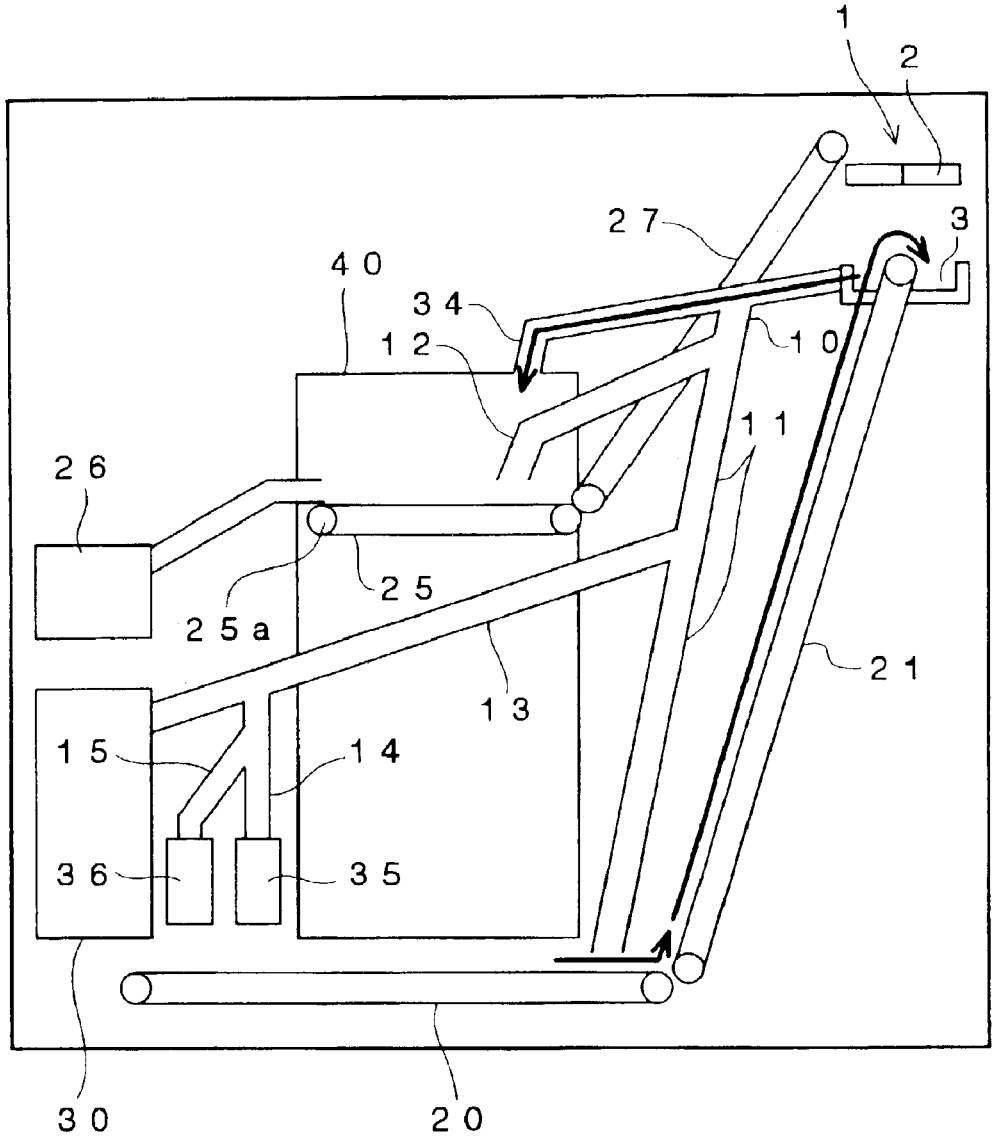
FIG. 10 is a schematic long-side cross-sectional view of a coin receiving and dispensing machine for showing a coin receiving process for finally receiving coins deposited via a coin receiving and dispensing opening and temporarily held on a coin receiving and dispensing belt.

FIG. 10 is a schematic long-side cross-sectional view of the coin receiving and dispensing machine for showing a coin receiving process for finally receiving coins deposited via the coin receiving and dispensing opening 1 and temporarily held on the coin receiving and dispensing belt 20.

When the control unit 50 receives the coin receipt instructing signal, it outputs drive signals to the first motor 56, the second motor 57, the rotatable disk motor 54 and the transporting belt motor 55, thereby driving the transporting belt 7, the coin receiving and dispensing belt 20 and the coin lift belt 21 and rotating the rotatable disk 3.

As a result, coins temporarily held on the coin receiving and dispensing belt 20 are fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating the denomination of the coin and counting the number of coins for each denomination and rewrites the number of coins accommodated in the coin receiving and dispensing machine stored in a stored coin number memory area of the RAM 52.

The coin is further transported by the transporting belt 7 in the coin passage 6 and accommodated in the coin storing box 40.

When all coins temporarily held on the coin receiving and dispensing belt 20 have been accommodated in the coin storing box 40 in this manner, the, control unit 50 outputs drive stop signals to the rotatable disk motor 54, the transporting belt motor 55, the first motor 56 and the second motor 57, thereby stopping the rotation of the rotatable disk 3 and the drive of transporting belt 7, the coin receiving and dispensing belt 20 and the coin lift belt 21, thus completing the coin receiving process.

On the other hand, coins discriminated unacceptable and returned onto the shutter 2 of the coin receiving and dispensing opening 1 are collected by the operator.

When, to the contrary, the coin receipt canceling switch 72 is operated, a coin receipt canceling signal is input to the control unit 50.

Figure 11:
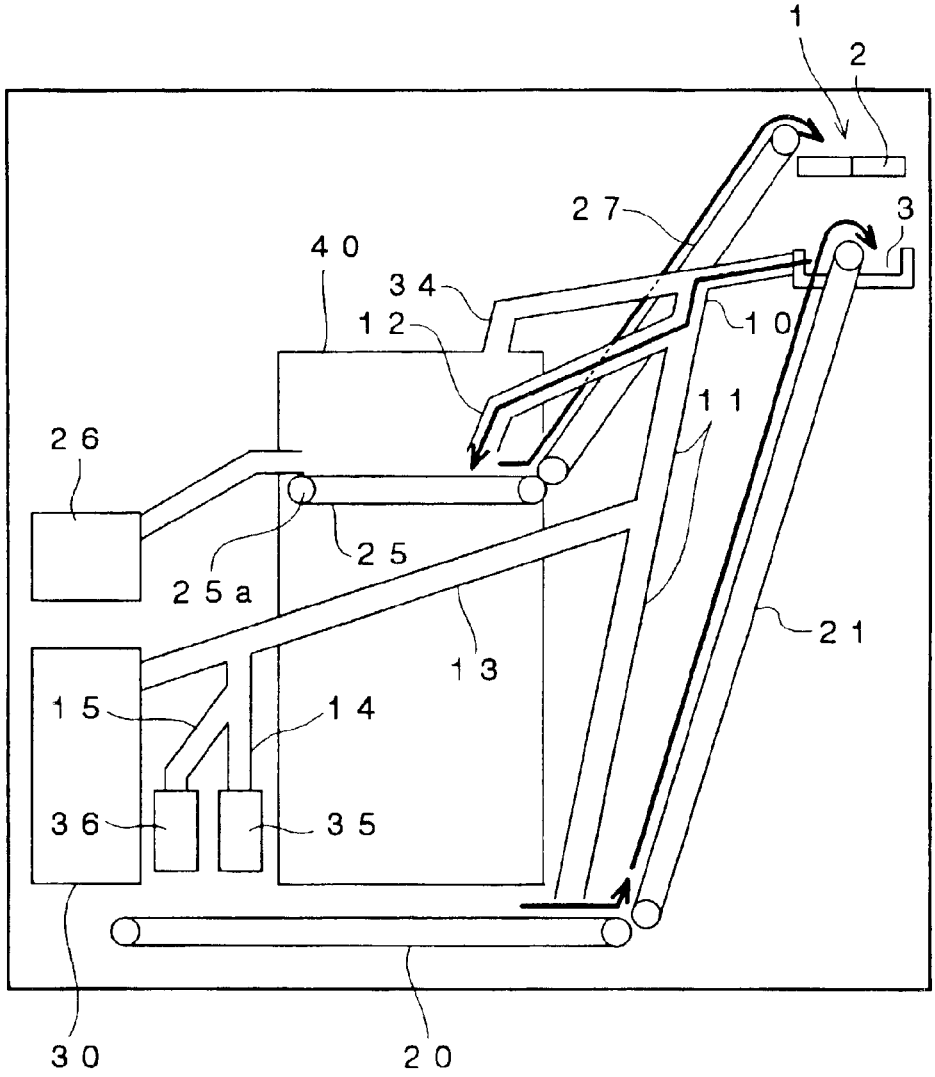
FIG. 11 is a schematic long-side cross-sectional view of a coin receiving and dispensing machine for showing a coin receipt canceling process for returning coins deposited via a coin receiving and dispensing opening and temporarily held on a coin receiving and dispensing belt to a coin receiving and dispensing opening.

FIG. 11 is a schematic long-side cross-sectional view of the coin receiving and dispensing machine for showing a coin receipt canceling process for returning coins deposited via the coin receiving and dispensing opening 1 and temporarily held on the coin receiving and dispensing belt 20 to the coin receiving and dispensing opening 1.

When the control unit 50 receives the coin receipt canceling signal, it outputs a drive signal to the sorting roller driving solenoid 60, thereby causing it to swing the sorting roller 10*b* from the position indicated by the solid line to the position indicated by the broken line in FIG. 4 to open the coin sorting passage 10. The control unit 50 further outputs a drive signal to the first solenoid 65 for driving the first gate member 16, thereby causing it to locate the first gate member 16 at a position where the coin sorting passage 10 and the second chute 12 communicate with each other.

Then, the control unit 50 outputs drive signals to the first motor 56, the second motor 57, the fourth motor 59, the rotatable disk motor 54 and the transporting belt motor 55, thereby driving the transporting belt 7, the coin receiving and dispensing belt 20, the coin lift belt 21 and the coin lift belt 27 and rotating the rotatable disk 3 and outputs a forward rotating signal to the third motor 58, thereby causing it to rotate the pulleys 25*a*, 25*a* around which the coin dispensing belt 25 is wound clockwise in FIG. 2.

As a result, coins temporarily held on the coin receiving and dispensing belt 20 are fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating the denomination of the coin. Then, based on the result of the discrimination, the control unit 50 subtracts one from the number of received coins of the denomination written in a received coin number memory area of the RAM 52 and rewrites received coin number data written in the received coin number memory area of the RAM 52.

The coin is further transported by the transporting belt 7 in the coin passage 6 and dropped into the coin sorting passage 10 since the coin sorting passage 10 is held open.

Since the first gate member 16 is held at a position where the coin sorting passage 10 communicates with the second chute 12 during the coin receipt canceling process, the coin dropped into the coin sorting passage 10 passes through the second chute 12 and is fed onto the coin dispensing belt 25.

Coins fed onto the coin dispensing belt 25 are transported by the coin dispensing belt 25 toward the coin receiving and dispensing opening 1 since the pulleys 25*a*, 25*a* around which the coin dispensing belt 25 is wound are rotated clockwise in FIG. 2 and they are delivered to the coin lift belt 27.

Coins delivered to the coin lift belt 27 are returned onto the shutter 2 of the coin receiving and dispensing opening 1.

Thus, when all coins temporarily held on the coin receiving and dispensing belt 20 have been returned onto the shutter 2 of the coin receiving and dispensing opening 1, the control unit 50 outputs drive stop signal to the first motor 56, the second motor 57, the fourth motor 59, the rotatable disk motor 54 and the transporting belt motor 55, thereby stopping the rotation of the rotatable disk 3 and the drive of the transporting belt 7, the coin receiving and dispensing belt 20, the coin lift belt 21, the coin dispensing belt 25 and the coin lift belt 27.

Then, the control unit 50 outputs a drive stop signal to the sorting roller driving solenoid 60, thereby causing it to return the sorting roller 10*b* to the position indicated by the solid line in FIG. 4 to close the coin sorting passage 10. The control unit 50 further outputs a drive stop signal to the first solenoid 65 for driving the first gate member 16, thereby causing it to locate the first gate member 16 at a position where the coin sorting passage 10 and the first chute 11 communicate with each other. Thus, the control unit 50 completes the coin receipt canceling process.

Figure 12:
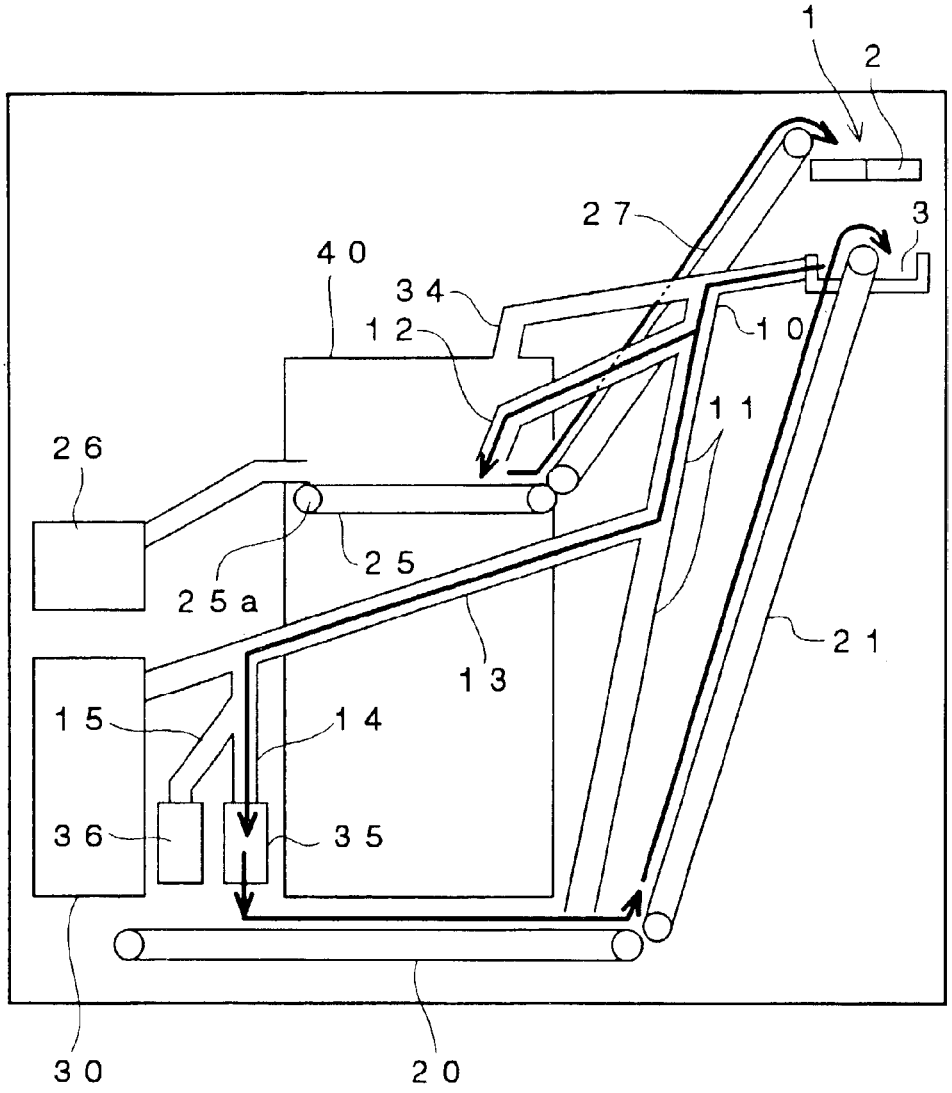
FIG. 12 is a schematic long-side cross-sectional view of a coin receiving and dispensing machine for showing a coin dispensing process for dispensing coins from a coin receiving and dispensing machine.

FIG. 12 is a schematic long-side cross-sectional view of the coin receiving and dispensing machine for showing a coin dispensing process for dispensing coins from the coin receiving and dispensing machine.

When coins are to be dispensed from the coin receiving and dispensing machine, the value of coins to be dispensed is first input using the ten key pad 77.

When the value of coins to be dispensed is first input using the ten key pad 77, a dispensed coin value specifying signal is output from the ten key pad 77 to the control unit 50. When the dispensed coin value specifying signal is input, the control unit 50 calculates the number of coins to be dispensed for each denomination to produce dispensed coin number data for each denomination based on the dispensed coin value specifying signal. Then, the control unit 50 writes the dispensed coin number data of each denomination in a dispensed coin number memory area of the RAM 52 and stores the dispensed coin number data of each denomination in a replenished coin number memory area of the RAM 52.

Then, the coin dispensation instructing switch 73 is operated.

When the coin dispensation instructing switch 73 is operated, a coin dispensation instructing signal is input to the control unit 50.

Although the coin receiving and dispensing machine according to this embodiment is constituted so as to dispense coins from either the first coin storing cylinder 35 or the second coin storing cylinder 36, in the case where coins were dispensed from one of the first coin storing cylinder 35 and the second coin storing cylinder 36 but coins to be dispensed have not yet replenished from the coin storing box 40, there is possibility that coins constituting one dispensed coin unit U are not stored in one of the first coin storing cylinder 35 and the second coin storing cylinder 36. Therefore, when the control unit 50 receives the coin dispensation instructing signal, in order to ensure that coins can be always dispensed from one coin storing cylinder containing coins constituting one dispensed coin unit U between the first coin storing cylinder 35 and the second coin storing cylinder 36, the control unit 50 first accesses the first dispensable coin number memory area and the second dispensable coin number memory area of the RAM 52 to read the number of coins of each denomination stored in the first coin storing cylinder 35 and the second coin storing cylinder 36 and judges whether or not coins constituting one dispensed coin unit U are stored in the first coin storing cylinder 35 and/or the second coin storing cylinder 36.

When the control unit 50 judges that coins constituting one dispensed coin unit U are stored in both the first coin storing cylinder 35 and the second coin storing cylinder 36, it causes the first coin storing cylinder 35 whose coin take-out section is located a short distance from the sensor unit 8 to dispense coins.

When the control unit 50 receives the coin dispensation instructing signal, it first outputs a drive signal to the sorting roller driving solenoid 60 to cause it to swing the sorting roller 10*b* from a position indicated by a solid line to a position indicated by a broken line in FIG. 4, thereby opening the coin sorting passage 10.

Then, the control unit 50 outputs drive signals to the first motor 56, the second motor 57, the fourth motor 59, the rotatable disk motor 54 and the transporting belt motor 55, thereby rotating the rotatable disk 3 and driving the transporting belt 7, the coin receiving and dispensing belt 20, the coin lift belt 21 and the coin lift belt 27 and outputs a forward rotating signal to the third motor 58, thereby causing it to rotate the pulleys 25*a*, 25*a* around which the coin dispensing belt 25 is wound clockwise in FIG. 2.

Further, the control unit 50 outputs a drive signal to the third take-out motor 63, thereby causing the coin take-out means 35*a* provided at a lower portion of the first coin storing cylinder 35 to take out coins stored in the first coin storing cylinder 35 onto the coin receiving and dispensing belt 20 one by one.

Coins taken out from the first coin storing cylinder 35 onto the coin receiving and dispensing belt 20 are delivered from the coin receiving and dispensing belt 20 onto the coin lift belt 21 and fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of discrimination in a discrimination result memory area of the RAM 52. Further, the control unit 50 rewrites dispensed coin number data of each denomination written in a dispensed coin number memory area of the RAM 52 by subtracting one from the number of coins of the denomination to be dispensed in the dispensed coin number data of each denomination.

The coin is further transported downstream in the coin passage 6 by the transporting belt 7 and when the coin is detected by the coin sensor 53 provided in the coin passage 6 in the vicinity of the coin sorting device 9, a coin detection signal is output to the control unit 50.

When the control unit 50 receives the coin detection signal, it reads out the result of discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive signal to the second solenoid 66 for driving the second gate member 17, thereby causing it to move the second gate member 17 to a position where the coin sorting passage 10 and the third chute 13 communicate with each other and outputs a drive signal to the fourth solenoid 68 for driving the fourth gate member 19, thereby causing it to move the fourth gate member 19 to a position where the third chute 13 and the first coin storing cylinder 35 communicate with each other via the fourth chute 14.

As a result, the coin sorting passage 10 is opened and since the fourth gate member 19 is held at a position where the third chute 13 and the first coin storing cylinder 35 communicate with each other via the fourth chute 14, the coin discriminated to be an unacceptable coin is dropped into the coin sorting passage 10 and returned into the first coin storing cylinder 35 via the first chute 11, the third chute 13 and the fourth chute 14.

In this embodiment, the coin discriminated to be an unacceptable coin is not accommodated in the unacceptable coin collecting box 41 but returned into the first coin storing cylinder 35 because coins stored in the first coin storing cylinder 35 have already been discriminated to be acceptable coins which are currently circulated genuine coins whose 10 damage levels are equal to or lower than the reference damage level and there is a risk of its being erroneously discriminated to be unacceptable during the coin dispensing process. Further, this is because for collecting the coin discriminated to be unacceptable in the unacceptable coin collecting box 41 it is necessary to feed the coin onto the coin dispensing belt 25 and rotate the pulleys 25*a*, 25*a* around which the coin dispensing belt 25 is wound counterclockwise in FIG. 2, which operation involves a risk of interfering with the coin dispensing operation.

When, to the contrary, the coin was discriminated to be an acceptable coin which is a currently circulated genuine coin whose damage level is equal to or lower than the reference damage level, the control unit 50 outputs a drive signal to the first solenoid 65 for driving the first gate member 16, thereby causing it to locate the first gate member 16 at a position where the coin sorting passage 10 and the second chute 12 communicate with each other.

As a result, the coin discriminated to be an acceptable coin which is a currently circulated genuine coin whose damage level is equal to or lower than the reference damage level is dropped into the coin sorting passage 10 and fed onto the coin dispensing belt 25 via the second chute 12.

The coin discriminated to be an acceptable coin which is a currently circulated genuine coin whose damage level is equal to or lower than the reference damage level and fed onto the coin dispensing belt 25 is transported toward the coin receiving and dispensing opening 1 since the pulleys 25*a*, 25*a* around which the coin dispensing belt 25 is wound are rotated clockwise in FIG. 2 and it is delivered onto the coin lift belt 27.

The coin delivered onto the coin lift belt 27 is dispensed onto the shutter 2 of the coin receiving and dispensing opening 1.

Every time detection signals are input from the sensor unit 8, the control unit 50 discriminates whether the coin is an acceptable coin which is a currently circulated genuine coin whose damage level is equal to or lower than the reference damage level. When the coin is discriminated to be an acceptable coin, the control unit 50 further discriminates the denomination of the coin and writes the result of discrimination in the discrimination result memory area of the RAM 52. At the same time, the control unit 50 rewrites the dispensed coin number data of each denomination written in a dispensed coin number memory area of the RAM 52 by subtracting one from the number of coins of the denomination to be dispensed in the dispensed coin number data of each denomination.

When the sequentially rewriting the dispensed coin number data of each denomination written in a dispensed coin number memory area of the RAM 52 in this manner causes the dispensed coin number data of a certain denomination to become zero, the control unit 50 no longer discriminates or counts coins of the denomination even if detection signals are input from the sensor unit 8. When a coin of the denomination is detected by the coin sensor 53, the control unit 50 outputs a drive signal to the second solenoid 66 for driving the second gate member 17, thereby causing it to move the second gate member 17 to a position where the coin sorting passage 10 and the third chute 13 communicate with each other and outputs a drive signal to the fourth solenoid 68 for driving the fourth gate member 19, thereby causing it to move the fourth gate member 19 to a position where the third chute 13 and the first coin storing cylinder 35 communicate with each other via the fourth chute 14.

As a result, the coin sorting passage 10 is opened and since the fourth gate member 19 is held at position where the third chute 13 and the first coin storing cylinder 35 communicate with each other via the fourth chute 14, the coin of the denomination whose dispensed coin number data of coins to be dispensed written in the dispensed coin number memory area of the RAM 52 has become zero is dropped into the coin sorting passage 10 and returned into the first coin storing cylinder 35 via the first chute 11, the third chute 13 and the fourth chute 14.

When the dispensed coin number data of all denominations of coins to be dispensed written in the dispensed coin number memory area of the RAM 52 have become zero, the control unit 50 outputs a drive stop signal to the third take-out motor 63, thereby causing it to stop the coin take-out means 35*a* provided at a lower portion of the first coin storing cylinder 35.

When all coins to be dispensed have been dispensed onto the shutter 2 and the coin take-out means 35*a* been stopped, then, after all of those among the coins already taken out from the coin storing box 35 onto the coin receiving and dispensing belt 20 that follow the coins to be dispensed have been collected in the first coin storing cylinder 35, the control unit 50 outputs drive stop signals to the first motor 56, the second motor 57, the third motor 58, the fourth motor 59, the rotatable disk motor 54 and the transporting belt motor 55, thereby stopping the rotation of the rotatable disk 3 and the drive of the transporting belt 7, the coin receiving and dispensing belt 20, the coin lift belt 21, the coin dispensing belt 25 and the coin lift belt 27.

Then, the control unit 50 outputs a drive stop signal to the sorting roller driving solenoid 60 to cause it to return the sorting roller 10*b* to a position indicated by a solid line in FIG. 4, thereby closing the coin sorting passage 10.

Further, the control unit 50 rewrites the number of coins of each denomination accommodated in the coin receiving and dispensing machine stored in a stored coin number memory area of the RAM 52 based on the dispensed coin number data stored in the replenished coin number memory area of the RAM 52, thus completing the coin dispensing process.

When the coin dispensing process is completed in this manner, the control unit 50 replenishes the first coin storing cylinder 35 with coins of the dispensed denomination.

Specifically, when the coin dispensing process is completed, the control unit 50 starts a coin replenishing process and first outputs a drive signal to the sorting roller driving solenoid 60 to cause it to swing the sorting roller 10*b* from a position indicated by a solid line to a position indicated by a broken line in FIG. 4, thereby opening the coin sorting passage 10.

Then, the control unit 50 outputs a drive signal to the second solenoid 66 for driving the second gate member 17, thereby causing it to move the second gate member 17 to a position where the coin sorting passage 10 and the third chute 13 communicate with each other and outputs a drive signal to the fourth solenoid 68 for driving the fourth gate member 19, thereby causing it to move the fourth gate member 19 to a position where the third chute 13 and the first coin storing cylinder 35 communicate with each other via the fourth chute 14.

The control unit 50 then outputs drive signals to the first motor 56, the second motor 57, the rotatable disk motor 54 and the transporting belt motor 55.

As a result, the transporting belt 7, the coin receiving and dispensing belt 20 and the coin lift belt 21 are driven and the rotatable disk 3 is rotated.

The control unit 50 further outputs a drive signal to the first take-out motor 61, thereby causing the coin take-out means 40*a* provided at a lower portion of the coin storing box 40 to take out coins stored in the coin storing box 40 onto the coin receiving and dispensing belt 20 one by one.

Coins taken out onto the coin receiving and dispensing belt 20 are delivered onto the coin lift belt 21 and fed onto the rotatable disk 3 by the coin lift belt 21.

Coins dropped onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, a surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of discrimination in a discrimination result memory area of the RAM 52. Further, the control unit 50 rewrites the deposited coin number data of each denomination stored in the replenished coin number memory area of the RAM 52 by subtracting one from the number of coins of the denomination to be dispensed in the deposited coin number data of each denomination.

The coin is further transported downstream in the coin passage 6 by the transporting belt 7 and when the coin is detected by the coin sensor 53 provided in the coin passage 6 in the vicinity of the coin sorting device 9, a coin detection signal is output to the control unit 50.

When the control unit 50 receives the coin detection signal, it reads out the result of discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive stop signal to the sorting roller driving solenoid 60 to cause it to return the sorting roller 10*b* to a position indicated by a solid line in FIG. 4, thereby closing the coin sorting passage 10.

As a result, the coin discriminated to be an unacceptable coin is further transported by the transporting belt 7 in the coin passage 6 and accommodated in the coin storing box 40 via the sixth chute 34.

In this embodiment, the coin discriminated to be an unacceptable coin is not collected in the unacceptable coin collecting box 41 but is accommodated in the coin storing box 40 because coins stored in the coin storing box 40 have already been discriminated to be acceptable coins which are currently circulated genuine coins whose damage levels are equal to or lower than the reference damage level and there is a risk of its being erroneously discriminated to be unacceptable during the coin replenishing process for the first coin storing cylinder 35.

When, to the contrary, the coin is discriminated to be an acceptable coin which is a currently circulated genuine coin whose damage level is equal to or lower than the reference damage level, the control unit 50 outputs no signal.

As a result, the coin discriminated to be an acceptable coin which is a currently circulated genuine coin whose damage level is equal to or lower than the reference damage level is accommodated in the first coin storing cylinder 35 via the first chute 11, the third chute 13 and the fourth chute 14.

Every time detection signals are input from the sensor unit 8, the control unit 50 discriminates whether or not a coin is an acceptable coin which is a currently circulated genuine coin whose damage level is equal to or lower than the reference damage level. When the control unit 50 discriminates that the coin is an acceptable coin, it further discriminates the denomination of the coin and writes the result of discrimination in the discrimination result memory area of the RAM 52. At the same time, the control unit 50 rewrites the dispensed coin number data of each denomination stored in the replenished coin number memory area of the RAM 52 by subtracting one from the number of coins of the denomination to be dispensed in the dispensed coin number data of each denomination.

When the number of coins of a certain denomination to be dispensed written in the replenished coin number memory area of the RAM 52, the control unit 50 does not discriminate or count a coin of the denomination even if detection signals are input from the sensor unit 8. When a coin of the denomination is detected by the coin sensor 53, the control unit 50 outputs a drive stop signal to the sorting roller driving solenoid 60 to cause it to return the sorting roller 10*b* to the position indicated by the solid line in FIG. 4, thereby closing the coin sorting passage 10.

As a result, the coin of the denomination whose number to be dispensed written in the replenished coin number memory area of the RAM 52 has become zero is further transported by the transporting belt 7 in the coin passage 6 and collected in the coin storing box 40 via the sixth chute 34.

When the numbers of coins of all denominations to be dispensed written in the replenished coin number memory area of the RAM 52 have become zero, the control unit 50 outputs a drive stop signal to the first take-out motor 61, thereby stopping the coin take-out means 40*a* provided at a lower portion of the coin storing box 40.

When all coins to be used to replenish the first coin storing cylinder 35 have been accommodated in the first coin storing cylinder and the coin take-out means 40*a* been stopped, then, after all of those among the coins already taken out from the coin storing box 40 onto the coin receiving and dispensing belt 20 that follow the coins used for replenishment have been collected in the coin storing box 40, the control unit 50 outputs drive stop signals to the first motor 56, the second motor 57, the third motor 58, the fourth motor 59, the rotatable disk motor 54 and the transporting belt motor 55, thereby stopping the rotation of the rotatable disk 3 and the drive of the transporting belt 7, the coin receiving and dispensing belt 20, the coin lift belt 21, the coin dispensing belt 25 and the coin lift belt 27.

Then, the control unit 50 outputs a drive stop signal to the sorting roller driving solenoid 60 to cause it to return the sorting roller 10*b* to a position indicated by a solid line in FIG. 4, thereby closing the coin sorting passage 10. The control unit 50 further rewrites the number of dispensable coins written in the dispensable coin number memory area of the RAM 52 by the number of coins constituting one dispensed coin unit U, thus completing the coin replenishing process for the first coin storing cylinder 35.

To the contrary, when the control unit 50 judges that coins constituting one dispensed coin unit U are contained in only one of the first coin storing cylinder 35 and the second coin storing cylinder 36, it dispenses coins from the coin storing cylinder containing coins constituting one dispensed coin unit U.

At the close of daily business, the ordinary practice is to discriminate whether or not every coin is an acceptable coin which is a currently circulated coin whose damage level is equal to or lower than the reference level, discriminate the denomination of the coin and count it for the denomination concerned if it is an acceptable coin, collect all coins accommodated in the coin receiving and dispensing machine in the coin cassette 30 while collecting unacceptable coins such as counterfeit coins, foreign coins, damaged coins whose damage levels are higher than the reference level and the like in the unacceptable coin collecting box 41, and remove the coin cassette 30 from the coin receiving and dispensing machine, thereby collecting all coins accommodated in the coin receiving and dispensing machine. On the other hand, at the start of daily business, the ordinary practice is to attach the coin cassette 30 to the coin receiving and dispensing machine, discriminate whether or not every coin is an acceptable coin which is a currently circulated coin whose damage level is equal to or lower than the reference level, discriminate the denomination of the coin and count it for the denomination concerned if it is an acceptable coin, and charge coins accommodated in the coin cassette 30 into the coin receiving and dispensing machine while collecting unacceptable coins such as counterfeit coins, foreign coins, damaged coins whose damage levels are higher than the reference level and the like in the unacceptable coin collecting box 41. Therefore, it is possible to accurately know the number of coins accommodated in the coin receiving and dispensing machine for each denomination when daily business is completed and it is possible to accurately know the number of coins accommodated in the coin receiving and dispensing machine for each denomination when daily business is started.

However, cases may arise in which daily business is finished without discriminating whether or not every coin is an acceptable coin which is a currently circulated coin whose damage level is equal to or lower than the reference level, discriminating the denomination of the coin and counting it for the denomination concerned if it is an acceptable coin, collecting all coins accommodated in the coin receiving and dispensing machine in the coin cassette 30 while collecting unacceptable coins such as counterfeit coins, foreign coins, damaged coins whose damage levels are higher than the reference level and the like in the unacceptable coin collecting box 41, and removing the coin cassette 30 from the coin receiving and dispensing machine, thereby collecting all coins accommodated in the coin receiving and dispensing machine, and daily business is started without attaching the coin cassette 30 to the coin receiving and dispensing machine, discriminating whether or not each coin is acceptable coins which is currently circulated coins whose damage level is equal to or lower than the reference level, discriminating the denomination of the coin and counting it for each denomination if it is an acceptable coin, and charging coins accommodated in the coin cassette 30 into the coin receiving and dispensing machine while collecting unacceptable coins such as counterfeit coins, foreign coins, damaged coins whose damage levels are higher than the reference level and the like in the unacceptable coin collecting box 41. In such cases, it is impossible to accurately know the number of coins accommodated in the coin receiving and dispensing machine for each denomination when daily business is completed and it is impossible to accurately know the number of coins accommodated in the coin receiving and dispensing machine for each denomination when daily business is started.

Therefore, the coin receiving and dispensing machine according to this embodiment is further constituted so as to be able to conduct an accommodated coin number confirmation process for periodically confirming the number of coins accommodated in the coin receiving and dispensing machine for each denomination.

When the accommodated coin number confirmation process for periodically confirming the number of coins accommodated in the coin receiving and dispensing machine for each denomination is to be conducted, the accommodated coin number confirmation switch 76 is operated and an accommodated coin number confirmation signal is output to the control unit 50.

When the control unit 50 receives the accommodated coin number confirmation signal, it first outputs drive signals to the first motor 56, the second motor 57, the rotatable disk motor 54 and the transporting belt motor 55, thereby driving the transporting belt 7, the coin receiving and dispensing belt 20 and the coin lift belt 21 and rotating the rotatable disk 3.

The control unit 50 then outputs a drive signal to the third take-out motor 63, thereby causing the coin take-out means 35*a* provided at a lower portion of the first coin storing cylinder 35 to take out coins stored in the first coin storing cylinder 35 onto the coin receiving and dispensing belt 20 one by one.

Coins taken out from the first coin storing cylinder 35 onto the coin receiving and dispensing belt 20 are delivered from the coin receiving and dispensing belt 20 onto the coin lift belt 21 and fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

Since all coins taken out from the first coin storing cylinder 35 are to be accommodated in the coin storing box 40 and whether or not coins are acceptable and the denomination thereof is to be discriminated when they are taken out from the coin storing box 40, the control unit 50 neither discriminates nor counts any of the coins even when the detection signals are input from the sensor unit 8.

Although the coin is fed to the coin sorting device 9, since the sorting roller 10*b* is normally held at a position where the coin sorting passage 10 is closed, the coin passes through the coin sorting device 9 and is fed into the coin storing box 40 via the sixth chute 34 connected to the terminal end portion of the coin passage 6 to be stored therein.

When a predetermined time period has passed after last detection signals were input from the sensor unit 8, the control unit 50 judges that all coins accommodated in the first coin storing cylinder 35 have been transferred into the coin storing box 40 and outputs a drive stop signal to the third take-out motor 63, thereby stopping the coin take-out means 35*a* provided at a lower portion of the first coin storing cylinder 35. At the same time, the control unit 50 outputs a drive signal to the fourth take-out motor 64, thereby driving the coin take-out means 36*a* provided at a lower portion of the second coin storing cylinder 36 to cause it to take out coins stored in the second coin storing cylinder 36 onto the coin receiving and dispensing belt 20 one by one.

Coins taken out from the second coin storing cylinder 36 onto the coin receiving and dispensing belt 20 are delivered from the coin receiving and dispensing belt 20 onto the coin lift belt 21 and fed onto the rotatable disk 3 by the coin lift belt 21.

Coins fed onto the rotatable disk 3 are moved along the inner surface of the ring-like guide 4 by a centrifugal force produced by the rotation of the rotatable, disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

Since all coins taken out from the second coin storing cylinder 36 are to be accommodated in the coin storing box 40 and whether or not coins are acceptable and the denomination thereof is to be discriminated when they are taken out from the coin storing box 40, the control unit 50 neither discriminates nor counts any of the coins even when the detection signals are input from the sensor unit 8.

Although the coin is fed to the coin sorting device 9, since the sorting roller 10*b* is normally held at a position where the coin sorting passage 10 is closed, the coin passes through the coin sorting device 9 and is fed into the coin storing box 40 via the sixth chute 34 connected to the terminal end portion of the coin passage 6 to be stored therein.

When a predetermined time period has passed after last detection signals were input from the sensor unit 8, the control unit 50 judges that all coins accommodated in the second coin storing cylinder 36 have been transferred into the coin storing box 40 and outputs a drive stop signal to the first motor 56, the second motor 57, the rotatable disk motor 54, the transporting belt motor 55 and the fourth take-out motor 64, thereby stopping the drive of the transporting belt 7, the coin receiving and dispensing belt 20, the coin lift belt 21 and the coin take-out means 36*a* provided at a lower portion of the second coin storing cylinder 36 and the rotation of the rotatable disk 3.

As a result, all coins accommodated in the coin receiving and dispensing machine are stored in the coin storing box 40.

When all coins accommodated in the coin receiving and dispensing machine have been stored in the coin storing box 40, the control unit 50 first outputs drive signals to the sorting roller driving solenoid 60 and the second solenoid 66, thereby causing the sorting roller driving solenoid 60 to swing the sorting roller 10*b* from the position indicated by the solid line to the position indicated by the broken line in FIG. 4 so as to open the coin sorting passage 10 and causing the second solenoid 66 to drive the second gate member 17 so that the coin sorting passage 10 communicates with the third chute 13.

The control unit 50 then outputs drive signals to the first motor 56, the second motor 57, the rotatable disk motor 54 and the transporting belt motor 55 and also outputs a reverse rotation signal to the third motor 58.

As a result, the transporting belt 7, the coin receiving and dispensing belt 20 and the coin lift belt 21 are driven and the rotatable disk 3 is rotated. Further, the pulleys 25*a*, 25*a* around which the coin dispensing belt 25 is wound are rotated counterclockwise.

The control unit 50 further outputs a drive signal to the first take-out roller 61, thereby causing the coin take-out means 40*a* provided at a lower portion of the coin storing box 40 to take out coins stored in the coin storing box 40 onto the coin receiving and dispensing belt 20 one by one.

Coins taken out from the coin storing box 40 onto the coin receiving and dispensing belt 20 are delivered from the coin receiving and dispensing belt 20 onto the coin lift belt 21 and fed onto the rotatable disk 3 by the coin lift belt 21.

Coins fed onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of discrimination in a discrimination result memory area of the RAM 52. Further, the control unit 50 counts the coins for the respective denominations and writes the number of coins of each denomination in a stored coin number memory area of the RAM 52.

The coin is further transported downstream in the coin passage 6 by the transporting belt 7 and when the coin is detected by the coin sensor 53 provided in the coin passage 6 in the vicinity of the coin sorting device 9, a coin detection signal is output to the control unit 50.

When the control unit 50 receives the coin detection signal, it reads out the result of discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive signal to the first solenoid 65 for driving the first gate member 16, thereby causing it to locate the first gate member 16 in a position where the coin sorting passage 10 and the second chute 12 communicate with each other.

As a result, the coin discriminated to be unacceptable is dropped into the coin sorting passage 10, led to the second chute 12 from the coin sorting passage 10 and fed onto the coin dispensing belt 25.

To the contrary, when the coin was discriminated to be an acceptable coin which is a currently circulated genuine coin whose damage level is equal to or lower than the reference damage level, the control unit 50 outputs no signal.

As a result, the coin discriminated to be an acceptable coin which is a currently circulated genuine coin whose damage level is equal to or lower than the reference damage level is dropped into the coin sorting passage 10, led to the third chute 13 from the coin sorting passage 10 and fed into the coin cassette 30 to be stored therein.

On the other hand, the coin discriminated to be unacceptable and fed onto the coin dispensing belt 25 is fed toward the coin collecting box 26 since a reverse rotation signal is output to the third motor 58 and the pulleys 25*a*, 25*a* around which the coin dispensing belt 25 is wound are rotated counterclockwise in FIG. 2.

The unacceptable coin is fed to the coin collecting passage 43 from the coin dispensing belt 25 and collected in the unacceptable coin collecting box 41 since the fifth gate member 46 is held at a position where the coin collecting passage 43 and the unacceptable coin collecting box 41 communicate with each other.

When all coins stored in the coin storing box 40 have been fed into the coin cassette 30 or the unacceptable coin collecting box 41 to be accommodated therein, the control unit 50 outputs drive stop signals to the first motor 56, the second motor 57, the third motor 58, the rotatable disk motor 54, the transporting belt motor 55 and the first take-out roller 61, thereby stopping the drive of the transporting belt 7, the coin receiving and dispensing belt 20, the coin lift belt 21, the coin dispensing belt 25 and the coin take-out means 40*a* provided at a lower portion of the coin storing box 40 and the rotation of the rotatable disk 3.

Then, the control unit 50 outputs drive stop signals to the sorting roller driving solenoid 60 and the second solenoid 66, thereby returning the sorting roller 10*b* to a position indicated by a solid line in FIG. 4 so as to open the coin sorting passage 10 and returning the second gate member 17 to a position where the coin sorting passage 10 and the first chute 11 communicate with each other.

When all coins stored in the coin storing box 40 have been fed into the coin cassette 30 or the unacceptable coin collecting box 41 to be accommodated therein, the number of coins accommodated in the coin receiving and dispensing machine is stored in the stored coin number memory area of the RAM 52 for each denomination.

Then, similarly to the coin charging process, all coins accommodated in the coin cassette 30 are transferred into the coin storing box 40 and accommodated in coin storing box 40.

In this manner, since the number of coins accommodated in the coin receiving and dispensing machine has been already stored in the stored coin number memory area of the RAM 52 for each denomination when coins are transferred from the coin cassette 30 into the coin storing box 40 and all unacceptable coins have been collected in the unacceptable coin collecting box 41, the coin cassette 30 contains no coin to be collected in the unacceptable coin collecting box 41 and, therefore, the control unit 50 neither discriminates nor counts any of the coins even when the detection signals are input from the sensor unit 8.

When all coins accommodated in the coin cassette 30 have been transferred into the coin storing box 40 and stored therein, the control unit 50 conducts the dispensed coin accommodating processing of coins to be dispensed to the first coin storing cylinder 35 and the second coin storing cylinder 36 and coins constituting one dispensed coin unit are fed into each of the first coin storing cylinder 35 and the second coin storing cylinder 36 to be stored therein.

Figure 13:
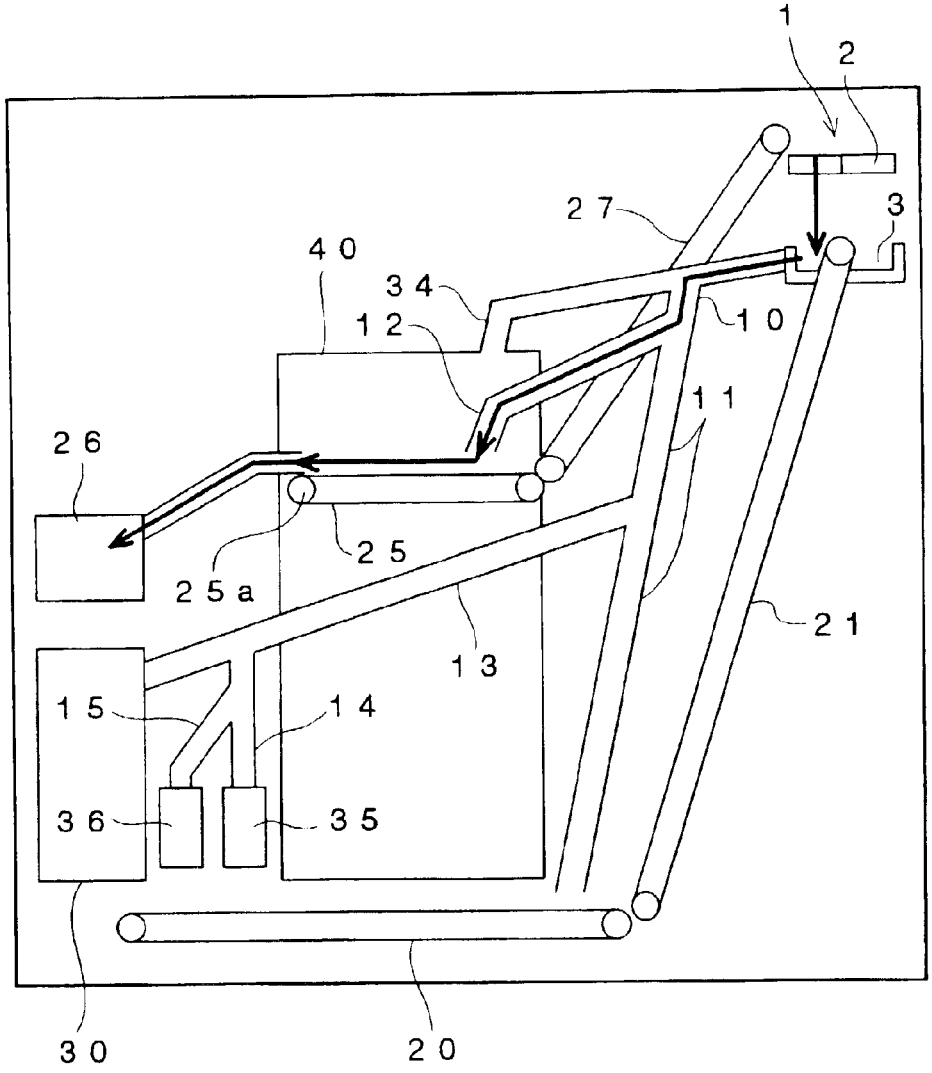
FIG. 13 is a schematic long-side cross-sectional view of a coin receiving and dispensing machine for showing an left-behind coin collecting process for collecting into a coin receiving and dispensing machine coins dispensed to a coin receiving and dispensing opening but left there without being collected by an operator or deposited coins returned to a coin receiving and dispensing opening but left there without being collected by an operator.

FIG. 13 is a schematic long-side cross-sectional view of the coin receiving and dispensing machine for showing a left-behind coin collecting process for collecting into the coin receiving and dispensing machine coins dispensed to the coin receiving and dispensing opening 1 but left there without being collected by an operator or deposited coins returned to the coin receiving and dispensing opening 1 but left there without being collected by an operator.

When coins remain on the shutter 2 of the coin receiving and dispensing opening 1 even after a predetermined time period has passed since coins were dispensed onto the shutter 2 of the coin receiving and dispensing opening 1 or received coins were returned onto the shutter 2 of the coin receiving and dispensing opening 1, the control unit 50 first outputs a drive signal to the sorting roller driving solenoid 60 to cause it to swing the sorting roller 10*b* from the position indicated by the solid line to the position indicated by the broken line in FIG. 4, thereby opening the coin sorting passage 10.

Then, the control unit 50 outputs drive signals to the first solenoid 65 for driving the first gate member 16 and the fifth solenoid 69 for driving the fifth gate member 46, thereby locating the first gate member 16 at a position where the coin sorting passage 10 and the second chute 12 communicate with each other and locating the fifth gate member 46 at a position where the coin collecting passage 43 and the eighth chute 45 communicate with each other.

Further, the control unit 50 outputs drive signals to the rotatable disk motor 54 and the transporting belt motor 55, thereby rotating the rotatable disk 3 and driving the transporting belt 7 and outputs a reverse rotation signal to the third motor 58, thereby rotating the pulleys 25*a*, 25*a* around which the coin dispensing belt 25 is wound counterclockwise in FIG. 2.

The control unit 50 outputs an opening signal to the shutter 2, thereby opening the shutter 2.

As a result, the rotatable disk 3 is rotated and the transporting belt 7 and the coin lift belt 21 are driven. Further, the pulleys 25*a*, 25*a* around which the coin dispensing belt 25 is wound are rotated counterclockwise in FIG. 2 and the shutter 2 of the coin receiving and dispensing opening 1 is opened, whereby coins remaining in the coin receiving and dispensing opening 1 are dropped onto the rotating rotatable disk 3.

Then, the control unit 50 outputs a closing signal to the shutter 2, thereby closing the shutter 2 of the coin receiving and dispensing opening Coins dropped onto the rotatable disk 3 are moved along the inner surface of the ring-like guide 4 by a centrifugal force produced by the rotation of the rotatable disk 3 and fed out one by one into the coin passage 6 via the slot 5.

Coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

In this embodiment, since all coins dispensed onto the shutter 2 of the coin receiving and dispensing opening 1 or returned onto the shutter 2 of the coin receiving and dispensing opening 1 but left there without being collected by the operator are to be accommodated in the left-behind coin storing box 42 and collected separately from coins stored in the coin storing box 40 and coins accommodated in the coin cassette 30, the control lo unit 50 neither discriminates nor counts coins during the left-behind coin collecting process.

The coin is further transported downstream by the transporting belt 7 in the coin passage 6 and dropped into the coin sorting passage 10 since the sorting roller 10*b* was swung from a position indicated by a solid line to a position indicated by a broken line in FIG. 4 and the coin sorting passage 10 is opened.

The coin dropped into the coin sorting passage 10 is fed onto the coin dispensing belt 25 via the second chute 12 since the first gate member 16 is located at a position where the coin sorting passage 10 and the second chute 12 communicate with each other.

The coin fed onto the coin dispensing belt 25 is fed toward the coin collecting box 26 since the pulleys 25*a*, 25*a* around which the coin dispensing belt 25 is wound are rotated counterclockwise in FIG. 2.

The coin is fed from the coin dispensing belt 25 into the coin collecting passage 43 and further fed into the left-behind coin storing box 42 via the eighth chute 45 to be stored therein since the fifth gate member 46 is located at a position where the coin collecting passage 43 and the eighth chute 45 communicate with each other.

When all coins dispensed onto the shutter 2 of the coin receiving and dispensing opening 1 or returned onto the shutter 2 of the coin receiving and dispensing opening 1 but left there without being collected by the operator have been fed into the left-behind coin storing box 42 and stored therein, the control unit 50 outputs drive stop signals to the rotatable disk motor 54, the transporting belt motor 55 and the third motor 58, thereby stopping the rotation of the rotatable disk 3 and the drive of the transporting belt 7 and the coin dispensing belt 25.

Then, the control unit 50 outputs a drive stop signal to the sorting lo roller driving solenoid 60 to cause it to return the sorting roller 10*b* to a position indicated by a solid line in FIG. 4, thereby closing the coin sorting passage 10 and outputs drive stop signals to the first solenoid 65 for driving the first gate member 16 and the fifth solenoid 69 for driving the fifth gate member 46, thereby returning the first gate member to a position where the coin sorting passage 10 and the first chute 11 communicate with each other and returning the fifth gate member 46 to a position where the coin collecting passage 43 and the seventh chute 44 communicate with each other. Thus, the control unit 50 completes the left-behind coin collecting process.

Figure 14:
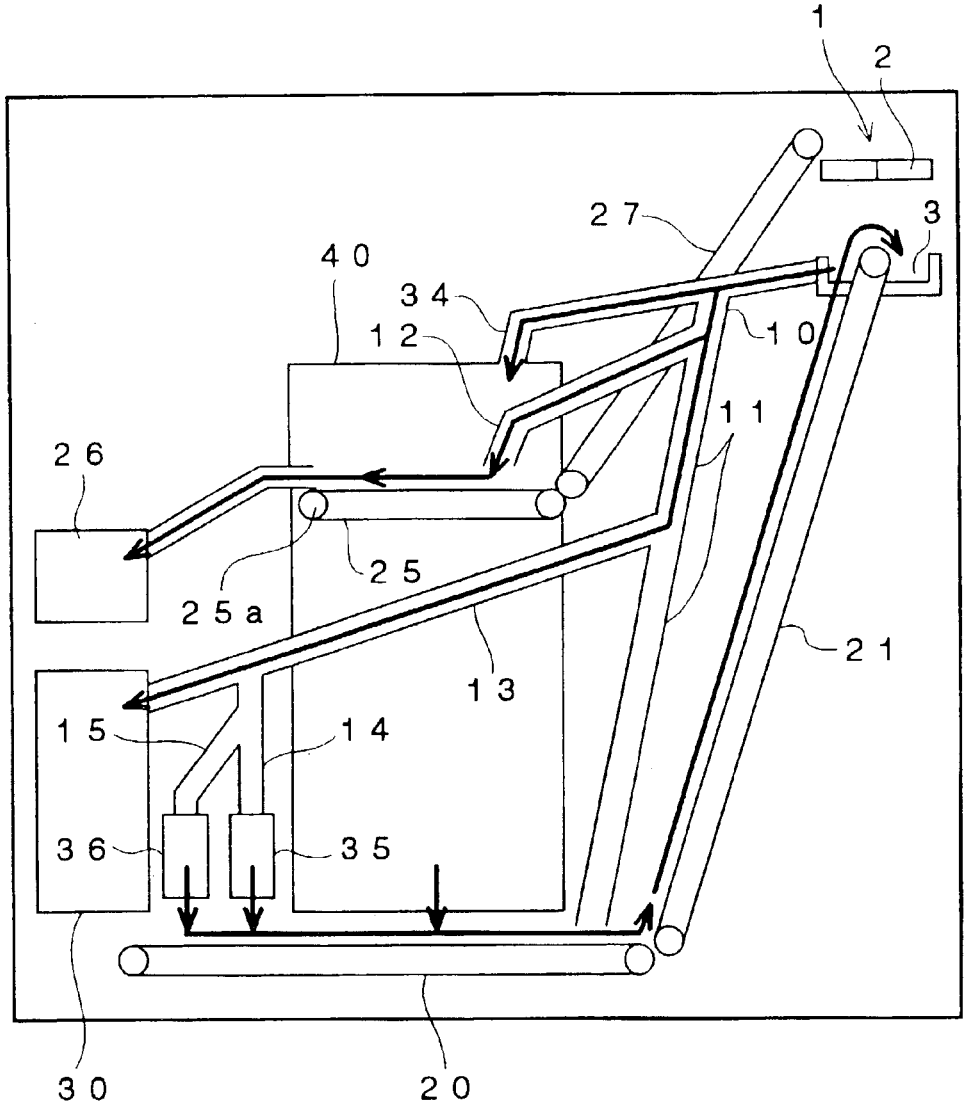
FIG. 14 is a schematic long-side cross-sectional view of a coin receiving and dispensing machine for showing a coin collecting process for collecting into a coin cassette coins accommodated in a coin receiving and, dispensing machine when daily business is completed.

FIG. 14 is a schematic long-side cross-sectional view of the coin receiving and dispensing machine for showing a coin collecting process for collecting coins accommodated in the coin receiving and dispensing machine when daily business is completed into the coin cassette 30.

At the close of daily business, the coin collecting instructing switch 75 is operated for collecting coins accommodated in the coin receiving and dispensing machine into the coin cassette 30.

When the coin collecting instructing switch 75 is operated, a coin collecting instructing signal is output to the control 50 and when the control unit 50 receives the coin collecting instructing signal, it outputs drive signals to the first motor 56, the second motor 57, the rotatable disk motor 54 and the transporting belt motor 55, thereby driving the transporting belt 7, the coin receiving and dispensing belt 20 and the coin lift belt 21 and rotating the rotatable disk 3.

The control unit 50 further outputs a reverse rotation signal to the third motor 58, thereby causing it to rotate the pulleys 25*a*, 25*a* around which the coin dispensing belt 25 is wound counterclockwise in FIG. 2.

Then, the control unit 50 outputs a drive signal to the third take-out motor 63, thereby causing the coin take-out means 35*a* provided at a lower portion of the first coin storing cylinder 35 to take out coins stored in the first coin storing cylinder 35 onto the coin receiving and dispensing belt 20 one by one.

Coins taken out from the first coin storing cylinder 35 onto the coin receiving and dispensing belt 20 are delivered from the coin receiving and dispensing belt 20 onto the coin lift belt 21 and fed onto the rotatable disk 3 by the coin lift belt 21.

The coins fed onto the rotatable disk 3 are moved along the inner surface of the ring-like guide 4 by a centrifugal force produced by the rotation of the rotatable disk 3 and fed out one by one into the coin passage 6 via the slot 5.

The coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, a surface pattern and the like, and magnetic properties of the coin are detected by the sensor unit 8, and detection signals are output to the control unit 50.

In this embodiment, since all coin taken out from the first coin storing cylinder 35 are to be stored in the coin storing box 40 and whether or not the coins are acceptable and the denominations thereof are to be discriminated when they are taken out from the coin storing box 40, the control unit 50 neither discriminates nor counts any of the coins even when the detection signals are input from the sensor unit 8.

The coin is further transported downstream by the transporting belt 7 in the coin passage 6, passes through the coin sorting device 9 and is fed into the coin storing box 40 via the sixth chute 34 connected to the terminal end portion of the coin passage 6 to be stored therein.

When a predetermined time period has passed after the last detection signals were input from the sensor unit 8, the control unit 50 judges that all coins stored in the first coin storing cylinder 35 have been transferred into the coin storing box 40 and outputs a drive stop signal to the third take-out motor 63, thereby stopping the coin take-out means 35*a* provided at a lower portion of the first coin storing cylinder 35. At the same time, the control unit 50 outputs a drive signal to the fourth take-out motor 64, thereby driving the coin take-out means 36*a* provided at a lower portion of the second coin storing cylinder 36 to cause it to take out coins stored in the second coin storing cylinder 36 onto the coin receiving and dispensing belt 20 one by one.

Coins taken out from the second coin storing cylinder 36 onto the coin receiving and dispensing belt 20 are delivered from the coin receiving and dispensing belt 20 onto the coin lift belt 21 and fed onto the rotatable disk 3 by the coin lift belt 21.

The coins fed onto the rotatable disk 3 are moved along the inner surface of the ring-like guide 4 by a centrifugal force, produced by the rotation of the rotatable disk 3 and fed out one by one into the coin passage 6 via the slot 5.

The coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

In this embodiment, since all coins taken out from the second coin storing cylinder 36 are to be stored in the coin storing box 40 and whether or not coins are acceptable and the denomination thereof are to be discriminated when they are taken out from the coin storing box 40, the control unit 50 neither discriminates nor counts any of the coins even when the detection signals are input from the sensor unit 8.

The coin is further transported downstream by the transporting belt 7 in the coin passage 6, passes through the coin sorting device 9 and is fed into the coin storing box 40 via the sixth chute 34 connected to the terminal end portion of the coin passage 6 to be stored therein.

When a predetermined time period has passed after the last detection signals were input from the sensor unit 8, the control unit 50 judges that all coins stored in the second coin storing cylinder 36 have been transferred into the coin storing box 40 and outputs a drive stop signal to the first motor 56, the second motor 57, the third motor 58, the rotatable disk motor 54, the transporting belt motor 55, the third solenoid 67 and the fourth take-out motor 63, thereby stopping the drive of the transporting belt 7, the coin receiving and dispensing belt 20, the coin dispensing belt 25, the coin lift belt 21 and the coin take-out means 36a provided at a lower portion of the second coin storing cylinder 36 and the rotation of the rotatable disk 3.

Then, all coins stored in the coin storing box 40 are to be collected in the coin cassette 30.

The control unit 50 first outputs drive signals to the sorting roller driving solenoid 60 and the second solenoid 66, thereby causing the sorting roller driving solenoid 60 to swing the sorting roller 10*b* from the position indicated by the solid line to the position indicated by the broken line in FIG. 4 so as to open the coin sorting passage 10 and causing the second solenoid 66 to drive the second gate member 17 so that the coin sorting passage 10 communicates with the third chute 13.

The control unit 50 then outputs drive signals to the first motor 56, the second motor 57, the rotatable disk motor 54 and the transporting belt motor 55.

As a result, the transporting belt 7, the coin receiving and dispensing belt 20 and the coin lift belt 21 are driven and the rotatable disk 3 is rotated.

Further, the control unit 50 outputs a reverse rotation signal to the third motor 58, thereby rotating the pulleys 25*a*, 25*a* around which the coin dispensing belt 25 is wound counterclockwise in FIG. 2.

The control unit 50 further outputs a drive signal to the first take-out roller 61, thereby causing the coin take-out means 40*a* provided at a lower portion of the coin storing box 40 to take out coins stored in the coin storing box 40 onto the coin receiving and dispensing belt 20 one by one.

Coins taken out from the coin storing box 40 onto the coin receiving and dispensing belt 20 are delivered from the coin receiving and dispensing belt 20 onto the coin lift belt 21 and fed onto the rotatable disk 3 by the coin lift belt 21.

The coins fed onto the rotatable disk 3 are moved along the inner surface of the ring-like guide 4 by a centrifugal force produced by the rotation of the rotatable disk 3 and fed out one by one into the coin passage 6 via the slot 5.

The coins fed into the coin passage 6 are transported in the direction indicated by the arrow A by the transporting belt 7 while being pressed by the transporting belt 7. When a coin reaches the sensor unit 8 provided in the coin passage 6, optical properties, such as the diameter, surface pattern and the like, and magnetic properties of the coin are detected by the sensor unit 8, and detection signals are output to the control unit 50.

When the control unit 50 receives the detection signals, it reads out reference diameter data, reference surface pattern data, reference magnetic data and reference damage level data stored in the ROM 51 for each denomination and compares them with the detection data input from the sensor unit 8, thereby discriminating whether or not the coin is an acceptable coin which is a currently circulated genuine coin whose damage level is equal to or lower than the reference damage level. When the control unit 50 discriminates that the coin is an acceptable coin, it further discriminates the denomination thereof and writes the result of discrimination in a discrimination result memory area of the RAM 52. Further, the control unit 50 counts the number of coins for each denomination and writes it in a collected coin number memory area of the RAM 52.

The coin is further transported downstream by the transporting belt 7 in the coin passage 6 and when the coin is detected by the coin sensor 53 provided in the coin passage 6 in the vicinity of the coin sorting device 9, a coin detection signal is output to the control unit 50.

When the control unit 50 receives the coin detection signal from the coin sensor 53, it reads out the result of discrimination of the coin stored in the discrimination result memory area of the RAM 52. When the coin was discriminated to be an unacceptable coin such as a counterfeit coin, a foreign coin, a damaged coin whose damage level is higher than the reference level or the like, the control unit 50 outputs a drive signal to the first solenoid 65 for driving the first gate member 16, thereby causing it to locate the first gate member 16 to a position where the coin sorting passage 10 and the second chute 12 communicate with each other.

As a result, the coin discriminated to be unacceptable is dropped into the coin sorting passage 10, led to the second chute 12 from the coin sorting passage 10 and fed onto the coin dispensing belt 25.

When, to the contrary, the coin was discriminated to be an acceptable coin which is a currently circulated genuine coin whose damage level is equal to or lower than the reference damage level, the control unit 50 outputs no signal.

As a result, the coin discriminated to be an acceptable coin which is a currently circulated genuine coin whose damage level is equal to or lower than the reference damage level passes through the third chute 13 since the second gate member 17 is located at a position where the coin sorting passage 10 and the third chute 13 communicate with each other and is fed into the coin cassette 30 to be collected therein.

On the other hand, the coin discriminated to be unacceptable and fed onto the coin dispensing belt 25 is fed toward the coin collecting box 26 since a reverse rotation signal is output to the third motor 58 and the pulleys 25*a*, 25*a* around which the coin dispensing belt 25 is wound are rotated counterclockwise in FIG. 2.

The unacceptable coin is fed to the coin collecting passage 43 from the coin dispensing belt 25 and collected in the unacceptable coin collecting box 41 since the fifth gate member 46 is held at a position where the coin collecting passage 43 and the unacceptable coin collecting box 41 communicate with each other.

When all coins stored in the coin storing box 40 have been fed into the coin cassette 30 or the unacceptable coin collecting box 41 to be accommodated therein in this manner, the control unit 50 outputs drive stop signals to the first motor 56, the second motor 57, the third motor 58, the rotatable disk motor 54, the transporting belt motor 55, the third solenoid 67 and the first take-out roller 61, thereby stopping the drive of the transporting belt 7, the coin receiving and dispensing belt 20, the coin dispensing belt 25, the coin lift belt 21 and the coin take-out means 40*a* provided at a lower portion of the coin storing box 40 and the rotation of the rotatable disk 3.

As described above, when all coins in the coin receiving and dispensing machine have been collected in the coin cassette 30 or the unacceptable coin collecting box 41, the coin cassette 30 is removed from the coin receiving and dispensing machine and coins are collected from the coin receiving and dispensing machine.

On the other hand, coins discriminated to be unacceptable and collected in the unacceptable coin collecting box 41 and coins collected in the left-behind coin storing box 42 are collected from the coin receiving and dispensing machine by operating an opening and closing member (not shown) for opening and closing the unacceptable coin collecting box 41 and the left-behind coin storing box 42.

According to the above described embodiment, since coins constituting one dispensed coin unit U are stored in each of the first coin storing cylinder 35 and the second coin storing cylinder 36 as coins to be dispensed, it is sufficient when coins are to be dispensed to take out only coins constituting one dispensed coin unit U from the first coin storing cylinder 35 or the second coin storing cylinder 36 and, therefore, the coin dispensation process can be completed for a short time.

Further, according to the above described embodiment, since all coins except coins stored in the first coin storing cylinder 35 and the second coin storing cylinder 36 and constituting two dispensed coin units at maximum are stored in the single coin storing box 40 and the coin receiving and dispensing machine is not provided with coin storing boxes for storing coins of different denominations, it is possible to make the coin receiving and dispensing machine small and markedly lower in cost.

Furthermore, according to the above described embodiment, since all coins except coins stored in the first coin storing cylinder 35 and the second coin storing cylinder 36 and constituting two dispensed coin units at maximum are stored in the single coin storing box 40 and the coin receiving and dispensing machine is not provided with coin storing boxes for storing coins of different denominations, it is unnecessary to provide an auxiliary coin storing box for coins which can be are no longer accommodated in either of the coin storing boxes for storing coins of different denominations. Therefore, it is possible to make the coin receiving and dispensing machine small and markedly lower cost of the coin receiving and dispensing machine.

Moreover, according to the above described embodiment, since all coins except coins stored in the first coin storing cylinder 35 and the second coin storing cylinder 36 and constituting two dispensed coin units at maximum are stored in the single coin storing box 40 and the coin receiving and dispensing machine is not provided with coin storing boxes for storing coins of different denominations, even if the number of received coins of one of the denominations has become excessive, coins of the denomination can be stored in the coin storing box 40. Therefore, since the operation of the coin receiving and dispensing machine need not to be stopped in order to collect coins which can be no longer accommodated in any of the coin storing boxes, it is possible to markedly improve the coin handling efficiency of the coin receiving and dispensing machine.

Further, according to the above described embodiment, since all coins except coins stored in the first coin storing cylinder 35 and the second coin storing cylinder 36 and constituting two dispensed coin units at maximum are stored in the single coin storing box 40 and the coin receiving and dispensing machine is not provided with coin storing boxes for storing coins of different denominations, it is possible to simplify the structure of the coin receiving and dispensing machine and improve the durability of the coin receiving and dispensing machine.

Furthermore, according to the above described embodiment, in the case where coins of a new denomination are issued, since it is unnecessary to secure a space for accommodating a coin storing box for storing coins of the newly issued denomination and dispensing the stored coins for dispensation and it is possible for the coin receiving and dispensing machine to receive and dispense the coins of the newly issued denomination only by changing the control program of the control unit 50, it is unnecessary to secure a space that at least initially serves no purpose in order to prepare for the case where coins of a new denomination are issued. It is therefore possible to make the coin receiving and dispensing machine much smaller and, on the other hand, it is possible to easily prepare for the case where coins of a new denomination are issued.

The present invention has thus been shown and described with reference to a specific embodiment. However, it should be noted that the present invention is in no way limited to the details of the described arrangements but changes and modifications may be made without departing from the scope of the appended claims.

For example, in the above described embodiment, although coins constituting one dispensed coin unit U are stored in each of the first coin storing cylinder 35 and the second coin storing cylinder 36, it is not absolutely necessary to store coins constituting one dispensed coin unit U in each of the first coin storing cylinder 35 and the second coin storing cylinder 36 and it is possible to store coins constituting two or more dispensed coin unit U in one of the first coin storing cylinder 35 and the second coin storing cylinder 36 or both of the first coin storing cylinder 35 and the second coin storing cylinder 36.

Further, in above described embodiment, although the coin receiving and dispensing machine is provided with the first coin storing cylinder 35 and the second coin storing cylinder 36 as a dispensed coin storing section for storing coins to be dispensed, it is not absolutely necessary for the coin receiving and dispensing machine to include the first coin storing cylinder 35 and the second coin storing cylinder 36 and the coin receiving and dispensing machine may include three or more dispensed coin storing cylinders for storing coins to be dispensed or only a single dispensed coin storing cylinder.

Furthermore, in above described embodiment, immediately after completion of the coin dispensing process, the dispensed coin accommodating process is conducted to replenish the first coin storing cylinder 35 and the second coin storing cylinder 36 with coins to be dispensed. However, since the coin receiving and dispensing machine includes the first coin storing cylinder 35 and the second coin storing cylinder 36, each accommodating coins constituting one dispensed coin unit U, it is not absolutely necessary to conduct the dispensed coin accommodating process in order to replenish the first coin storing cylinder 35 and the second coin storing cylinder 36 with coins to be dispensed immediately after completion of the coin dispensing process and the control unit 50 may conduct the dispensed coin accommodating process for the first coin storing cylinder 35 or the second coin storing cylinder 36 based on the dispensed coin number data stored in the replenished coin number memory area of the RAM 52 when the control unit 50 judges based on the number of stored coins for each denomination stored in the first dispensable coin number memory area and the second dispensable coin number memory area of the RAM 52 that the number of coins of one of denominations has become smaller than that of coins constituting one dispensed coin unit U in both the first coin storing cylinder 35 and the second coin storing cylinder 36.

Moreover, in the above described embodiment, in the case of dispensing coins, when the control unit 50 judges that coins whose number is equal to that of coins constituting one dispensed coin unit U are present in both the first coin storing cylinder 35 and the second coin storing cylinder 36, the control unit 50 takes out coins from the first coin storing cylinder 35 whose coin take-out section is located a short distance from the sensor unit 8 and dispenses the coins to the coin receiving and dispensing opening 1. However, in the case where coins constituting one dispensed coin unit U are stored in both the first coin storing cylinder 35 and the second coin storing cylinder 36, coins may be taken out form the second coin storing cylinder 36 and dispensed to the coin receiving and dispensing opening 1.

Further, in the above described embodiment, the coin passage 6 is formed so as to substantially horizontally extend from the rotatable disk 3 in the coin receiving and dispensing machine and the coin lift belt 27 is provided so as to be adjacent to the coin dispensing belt 25 for lifting coins to a height level of the rotatable disk 3. However, it is not absolutely necessary to form the coin passage 6 so as to substantially horizontally extend from the rotatable disk 3 in the coin receiving and dispensing machine and provide the coin lift belt 27 so as to be adjacent to the coin dispensing belt 25 for lifting coins to the height level of the coin receiving and dispensing opening 1 and as disclosed in Japanese Patent Application Laid Open No. 2001-43420, it is possible to constitute a part of the coin passage by an endless chain wound around a sprocket wheel and a support plate mounted on the main body at an angle with the horizontal direction and adapted for supporting coins so that coins can be lifted by the coin passage to the height level of the coin receiving and dispensing opening 1.

Furthermore, in above described embodiment, although the coin storing box 40 is disposed at a substantially central portion of the coin receiving and dispensing machine, the coin storing box 40 may be disposed at a front portion of the coin receiving and dispensing machine and the position thereof is not particularly limited.

Moreover, in above described embodiment, the first chute 11 communicating with the coin receiving and dispensing belt 20 and the second chute 12 communicating with the coin dispensing belt 25 branch from the coin sorting passage 10 and the third chute 13 communicating with the coin cassette 30 branches from the first chute 11. The fourth chute 14 communicating with the first coin storing cylinder 35 branches from the third chute 13 and the fifth chute 15 communicating with the second coin storing cylinder 36 branches from the fourth chute 14. The sixth chute 34 communicating with the coin storing box 40 is further provided independently of the coin passage 6. However, any configuration can be employed insofar as coins fed into the coin passage 6 can be selectively fed onto the coin receiving and dispensing belt 20, onto the coin dispensing belt 25, into the coin cassette 30, into the first coin storing cylinder 35, and into the second coin storing cylinder 36 or the coin storing box 40.

Further, in above described embodiment, although coins to be dispensed are stored in the first coin storing cylinder 35 and the second coin storing cylinder 36 or the coin storing box 40, it is sufficient to store coins to be dispensed in a coin storing section having a small volume and it is not absolutely necessary to store coins to be dispensed in a cylindrical storing section.

Furthermore, in above described embodiment, although the coin collecting box 26 of the coin receiving and dispensing machine is provided with the unacceptable coin collecting box 41 for collecting unacceptable coins such as counterfeit coins, foreign coins, damaged coins whose damage levels are higher than the reference level and the like and the left-behind coin storing box 42 for storing coins dispensed to the coin receiving and dispensing opening 1 but left there without being collected by the operator or deposited coins returned to the coin receiving and dispensing opening 1 but left there without being collected by the operator, the unacceptable coin collecting box 41 may be divided into a first unacceptable coin collecting box and a second unacceptable coin collecting box so that the unacceptable coin collecting box is adapted to collect coins discriminated to be unacceptable when coins are to be charged in the coin receiving and dispensing machine such as counterfeit coins, foreign coins, damaged coins whose damage levels are higher than the reference level and the like and that the second unacceptable coin collecting box is adapted to collect coins discriminated to be unacceptable when coins are to be collected from the coin receiving and dispensing machine such as counterfeit coins, foreign coins, damaged coins whose damage levels are higher than the reference level and the like. When coins are to be charged in the coin receiving and dispensing machine, since unacceptable coins such as counterfeit coins, foreign coins, damaged coins whose damage levels may be contained in coins to be charged in the coin receiving and dispensing machine, it is indispensable to collect coins discriminated to be unacceptable when coins are to be charged in the coin receiving and dispensing machine such as counterfeit coins, foreign coins, damaged coins whose damage levels as unacceptable coins. On the other hand, since coins stored in the coin storing box 40, the first coin storing box 35 and the second coin storing box 36 of the coin receiving and dispensing machine were discriminated to be acceptable when they were stored therein, coins discriminated to be unacceptable when coins are to be collected from the coin receiving and dispensing machine such as counterfeit coins, foreign coins, damaged coins whose damage levels might be erroneously discriminated to be unacceptable for some reason. Therefore, in the case of collecting coins discriminated to be unacceptable when coins are to be charged in the coin receiving and dispensing machine such as counterfeit coins, foreign coins, damaged coins whose damage levels as unacceptable coins and coins discriminated to be unacceptable when coins are to be collected from the coin receiving and dispensing machine such as counterfeit coins, foreign coins, damaged coins whose damage levels in the single unacceptable coin collecting box 41, it may be necessary to again discriminate coins but in the case of dividing the unacceptable coin collecting box 41 into the first unacceptable coin collecting box and the second unacceptable coin collecting box, collecting coins discriminated to be unacceptable when coins are to be charged in the coin receiving and dispensing machine such as counterfeit coins, foreign coins, damaged coins whose damage levels in the first unacceptable coin collecting box, and collecting coins discriminated to be unacceptable when coins are to be collected from the coin receiving and dispensing machine such as counterfeit coins, foreign coins, damaged coins whose damage levels in the second unacceptable coin collecting box, it is advantageous in that such an unnecessary coin discriminating operation is not required.

Further, in the present invention, the respective means need not necessarily be physical means and arrangements whereby the functions of the respective means are accomplished by software fall within the scope of the present invention. In addition, the function of a single means may be accomplished by two or more physical means and the functions of two or more means may be accomplished by a single physical means.

According to the present invention, it is possible to provide a coin receiving and dispensing machine which can be made compact and low in cost and can easily receive and dispense coins of newly issued denomination.

What is claimed is:

1. A coin receiving and dispensing machine comprising a coin receiving and dispensing opening through which coins can be deposited and dispensed, sensor means-provided in a coin passage and adapted for discriminating whether coins are acceptable and denominations of coins and counting the coins of each denomination, a single coin storing box for storing acceptable coins, at least one coin storing means for storing coins to be dispensed, and control means for controlling overall operation of the coin receiving and dispensing machine, the control means being constituted so as to, prior to dispensation of coins, take out coins stored in the coin storing box, cause the sensor means to discriminate denominations of the coins taken out from the coin storing box and count the number of the coins for each denomination, and store a predetermined number of coins in the at least one coin storing means for each denomination based on the discrimination and counting done by the sensor means, the control means being further constituted so as to, when coins are to be dispensed, take out coins stored in the at least one coin storing means, cause the sensor means to discriminate denominations of coins taken out from the at least one coin storing means and count the number of the coins of each denomination, and feed the coins to the coin receiving and dispensing opening based on the discrimination and counting done by the sensor means, the control means furthermore being constituted so as to cause the sensor means to discriminate whether or not coins deposited through the coin receiving and dispensing opening are acceptable and denominations of coins discriminated to be acceptable and count the number of the coins of each denomination, and store the coins deposited through the coin receiving and dispensing opening in the coin storing box.

2. A coin receiving and dispensing machine in accordance with claim 1 wherein the control means is constituted so as to store, prior to coin dispensation, in the at least one coin storing means coins whose value is equal to a maximum value of coins to be dispensed by one coin dispensing operation as one dispensed coin unit.

3. A coin receiving and dispensing machine in accordance with claim 2 wherein the control means is constituted so as to select coins of individual denominations for constituting the one dispensed coin unit in such a manner that the total number of the coins is minimum, and store the one dispensed coin unit in the at least one coin storing means prior to coin dispensation.

4. A coin receiving and dispensing machine in accordance with claim 2 wherein the control means is constituted so as to store two or more dispensed coin units of coins in the at least one coin storing means prior to coin dispensation.

5. A coin receiving and dispensing machine in accordance with claim 3 wherein the control means is constituted so as to store two or more dispensed coin units of coins in the at least one coin storing means prior to coin dispensation.

6. A coin receiving and dispensing machine in accordance with claim 2 wherein the control means is constituted so as to, after the coin dispensing operation, take out coins stored in the coin storing box, cause the sensor means to discriminate the denominations of the coins taken out from the coin storing box and count the number thereof for each denomination, and, based on the results of discrimination and counting done by the sensor means, replenish the at least one coin storing means with coins whose number of each denomination is equal to that of the dispensed coins.

7. A coin receiving and dispensing machine in accordance with claim 3 wherein the control means is constituted so as to, after the coin dispensing operation, take out coins stored in the coin storing box, cause the sensor means to discriminate the denominations of the coins taken out from the coin storing box and count the number thereof for each denomination, and, based on the results of discrimination and counting done by the sensor means, replenish the at least one coin storing means with coins whose number of each denomination is equal to that of the dispensed coins.

8. A coin receiving and dispensing machine in accordance with claim 4 wherein the control means is constituted so as to, after the coin dispensing operation, take out coins stored in the coin storing box, cause the sensor means to discriminate the denominations of the coins taken out from the coin storing box and count the number thereof for each denomination, and, based on the results of discrimination and counting done by the sensor means, replenish the at least one coin storing means with coins whose number of each denomination is equal to that of the dispensed coins.

9. A coin receiving and dispensing machine in accordance with claim 5 wherein the control means is constituted so as to, after the coin dispensing operation, take out coins stored in the coin storing box, cause the sensor means to discriminate the denominations of the coins taken out from the coin storing box and count the number thereof for each denomination, and, based on the results of discrimination and counting done by the sensor means, replenish the at least one coin storing means with coins whose number of each denomination is equal to that of the dispensed coins.

10. A coin receiving and dispensing machine in accordance with claim 2 which comprises two or more coin storing means for storing coins to be dispensed and wherein the control means is constituted so as to store coins constituting one dispensed coin unit in each of the two or more coin storing means prior to a coin dispensing operation, selectively take out coins from one of the two or more coin storing means, cause the sensor means to discriminate denominations of the coins taken out from one of the two or more coin storing means and count the number thereof for each denomination, and dispense the coins into the coin receiving and dispensing opening based on the results of discrimination and counting done by the sensor means.

11. A coin receiving and dispensing machine in accordance with claim 3 which comprises two or more coin storing means for storing coins to be dispensed and wherein the control means is constituted so as to store coins constituting one dispensed coin unit in each of the two or more coin storing means prior to a coin dispensing operation, selectively take out coins from one of the two or more coin storing means, cause the sensor means to discriminate denominations of the coins taken out from one of the two or more coin storing means and count the number thereof for each denomination, and dispense the coins into the coin receiving and dispensing opening based on the results of discrimination and counting done by the sensor means.

12. A coin receiving and dispensing machine in accordance with claim 10 wherein the control means is constituted so as to store coins constituting two or more dispensed coin units in at least one of the two or more coin storing means prior to dispensing coins.

13. A coin receiving and dispensing machine in accordance with claim 11 wherein the control means is constituted so as to store coins constituting two or more dispensed coin units in at least one of the two or more coin storing means prior to dispensing coins.

14. A coin receiving and dispensing machine in accordance claim 2 which further comprises a coin cassette provided at one of a front section and a rear section in a main body for accommodating coins and wherein the coin cassette is adapted for accommodating coins to be stored in the coin storing box and the control means is adapted for, prior to a receiving operation and dispensing operation of coins, taking out coins accommodated in the coin cassette, causing the sensor means to discriminate whether or not the coins taken out from the coin cassette are acceptable and the denomination thereof and count the number thereof for each denomination, and storing, based on the results of discrimination and counting by the sensor means, coins discriminated by the sensor means to be acceptable in the coin storing box.

15. A coin receiving and dispensing machine in accordance claim 3 which further comprises a coin cassette provided at one of a front section and a rear section in a main body for accommodating coins and wherein the coin cassette is adapted for accommodating coins to be stored in the coin storing box and the control means is adapted for, prior to a receiving operation and dispensing operation of coins, taking out coins accommodated in the coin cassette, causing the sensor means to discriminate whether or not the coins taken out from the coin cassette are acceptable and the denomination thereof and count the number thereof for each denomination, and storing, based on the results of discrimination and counting by the sensor means, coins discriminated by the sensor means to be acceptable in the coin storing box.

16. A coin receiving and dispensing machine in accordance with claim 14 which further comprises a transporting belt for transporting coins taken out from the coin cassette and the coin storing box and the transporting belt is constituted so as to temporarily hold coins deposited through the coin receiving and dispensing opening and discriminated by the sensor unit to be acceptable.

17. A coin receiving and dispensing machine in accordance with claim 15 which further comprises a transporting belt for transporting coins taken out from the coin cassette and the coin storing box and the transporting belt is constituted so as to temporarily hold coins deposited through the coin receiving and dispensing opening and discriminated by the sensor unit to be acceptable.

18. A coin receiving and dispensing machine in accordance with claim 14 wherein the control means is constituted so as to take out the coins stored in the at least one coin storing means and the coins stored in the coin storing box, cause the sensor means to discriminate whether or not the coins taken out from the at least one coin storing means and the coins taken out from the coin storing box are acceptable and the denominations thereof when they are acceptable and count the number thereof for each denomination, and accommodate coins discriminated to be acceptable in the coin cassette.

19. A coin receiving and dispensing machine in accordance with claim 15 wherein the control means is constituted so as to take out the coins stored in the at least one coin storing means and the coins stored in the coin storing box, cause the sensor means to discriminate whether or not the coins taken out from the at least one coin storing means and the coins taken out from the coin storing box are acceptable and the denominations thereof when they are acceptable and count the number thereof for each denomination, and accommodate coins discriminated to be acceptable in the coin cassette.

20. A coin receiving and dispensing machine in accordance with claim 16 wherein the control means is constituted so as to take out the coins stored in the at least one coin storing means and the coins stored in the coin storing box, cause the sensor means to discriminate whether or not the coins taken out from the at least one coin storing means and the coins taken out from the coin storing box are acceptable and the denominations thereof when they are acceptable and count the number thereof for each denomination, and accommodate coins discriminated to be acceptable in the coin cassette.

21. A coin receiving and dispensing machine in accordance with claim 17 wherein the control means is constituted so as to take out the coins stored in the at least one coin storing means and the coins stored in the coin storing box, cause the sensor means to discriminate whether or not the coins taken out from the at least one coin storing means and the coins taken out from the coin storing box are acceptable and the denominations thereof when they are acceptable and count the number thereof for each denomination, and accommodate coins discriminated to be acceptable in the coin cassette.

22. A coin receiving and dispensing machine in accordance with claim 14 which further comprises an unacceptable coin collecting box accessible from the outside and adapted for storing unacceptable coins and the control means is constituted so as to collect coins discriminated by the sensor means to be not acceptable in the unacceptable coin collecting box.

23. A coin receiving and dispensing machine in accordance with claim 15 which further comprises an unacceptable coin collecting box accessible from the outside and adapted for storing unacceptable coins and the control means is constituted so as to collect coins discriminated by the sensor means to be not acceptable in the unacceptable coin collecting box.

24. A coin receiving and dispensing machine in accordance with claim 18 which further comprises an unacceptable coin collecting box accessible from the outside and adapted for storing unacceptable coins and the control means is constituted so as to collect coins discriminated by the sensor means to be not acceptable in the unacceptable coin collecting box.

25. A coin receiving and dispensing machine in accordance with claim 19 which further comprises an unacceptable coin collecting box accessible from the outside and adapted for storing unacceptable coins and the control means is constituted so as to collect coins discriminated by the sensor means to be not acceptable in the unacceptable coin collecting box.

26. A coin receiving and dispensing machine in accordance with claim 20 which further comprises an unacceptable coin collecting box accessible from the outside and adapted for storing unacceptable coins and the control means is constituted so as to collect coins discriminated by the sensor means to be not acceptable in the unacceptable coin collecting box.

27. A coin receiving and dispensing machine in accordance with claim 21 which further comprises an unacceptable coin collecting box accessible from the outside and adapted for storing unacceptable coins and the control means is constituted so as to collect coins discriminated by the sensor means to be not acceptable in the unacceptable coin collecting box.

* * * * *